US005897296A

United States Patent [19]

Yamamoto et al.

[11] Patent Number: 5,897,296

[45] Date of Patent: Apr. 27, 1999

[54] VIBRATING COMPRESSOR

[75] Inventors: Hideo Yamamoto, Osaka; Koyo Shibuya, Nara; Takashi Satomura, Kobe; Ichiro Morita, Fujisawa; Noriyuki Fujiwara; Akihisa Nakahashi, both of Osaka, all of Japan

[73] Assignee: Matsushita Electric Industrial Co., Ltd., Japan

[21] Appl. No.: 08/710,204

[22] Filed: Sep. 13, 1996

[30] Foreign Application Priority Data

Nov. 15, 1995 [JP] Japan ..... 7-296736

[51] Int. Cl.[6] ..... F04B 49/06

[52] U.S. Cl. ..... 417/44.1; 417/1; 62/132

[58] Field of Search ..... 417/1, 44.1; 62/132, 62/133; 418/40; 324/207.11–207.26; 318/652–661

[56] References Cited

U.S. PATENT DOCUMENTS

| | | | |
|---|---|---|---|
| 4,879,528 | 11/1989 | Gotanda | 331/4 |
| 5,172,040 | 12/1992 | Sasaki et al. | 318/871 |
| 5,327,336 | 7/1994 | Ohkubo et al. | 363/97 |
| 5,365,810 | 11/1994 | Inaniwa et al. | 81/430 |
| 5,658,132 | 8/1997 | Akazawa et al. | 417/45 |

FOREIGN PATENT DOCUMENTS

| | | |
|---|---|---|
| 2145679 | 12/1990 | Japan . |
| 5023347 | 4/1993 | Japan . |

*Primary Examiner*—Ayaz R. Sheikh
*Assistant Examiner*—Xuan M. Thai
*Attorney, Agent, or Firm*—Rossi & Associates

[57] ABSTRACT

A vibrating compressor of the present invention, which comprises a piston driving section for driving a piston by supplying a piston driving force, a displacement detecting section connected in an axial direction of the piston, an upper dead point position detecting section for detecting an upper dead point position based on a piston position signal from the displacement detecting section, and a driving force control section for changing the driving force supplied to the piston by the piston driving section according to a difference between the upper dead point position and a preset upper dead point position reference value immediately after the upper dead point position detecting section detects the upper dead point position, prevents its compression efficiency from decreasing due to stabilization and prevents a device from being damaged. In the vibrating compressor, it is also possible to calculate a stroke based on a detected piston position or to control the driving force based on a detected frequency.

3 Claims, 25 Drawing Sheets

FIG. 20

| | | |
|---|---|---|
| START | | 50.0Hz |
| STEP | | 0.1Hz |
| DATA | 1 | 0.57A |
| | 2 | 0.54A |
| | 3 | 0.52A |
| | | ⋮ |
| | i | 0.38A |
| | | ⋮ |
| | n | 0.46A |
| MINIMUM | | i |

VIBRATING COMPRESSOR

BACKGROUND OF THE INVENTION

1. Field of the Invention

The present invention relates to a vibrating or linear compressor which can be used for a refrigerator.

2. Related Art

A vibrating compressor is used for a refrigerator because of a simple configuration, compact and light weight features, a high force rate, and low power consumption. There is a conventional vibrating compressor described in Japanese Patent Publication No. 5-23347 of 1993 as one of the conventional vibrating compressors. The conventional vibrating compressor is described below with reference to FIG. 24.

Referring to FIG. 24, there are shown a control circuit 1, a temperature detecting section 1-1, a calculating section 1-2, a driving circuit 1-3, temperature detectors 2 and 3, a driving section 4, a compressor 5, a condenser 6, a vacuum device 7, a refrigerator 8, and an evaporator 8-1. The control circuit 1, which comprises a temperature detecting section 1-1, a calculating section 1-2, and a driving circuit 1-3, outputs a driving signal of a frequency driven by the compressor 5 based on a signal from the temperature detector 2 for detecting a temperature corresponding to a saturated vapor pressure of refrigerant taken in by the compressor 5 and the temperature detector 3 for detecting a temperature corresponding to a saturated vapor pressure of refrigerant which is ejected with compression by the compressor 5.

Now an operation of the conventional vibrating compressor is described below. The temperature detecting section 1-1 converts a signal detected by the temperature detectors 2 and 3 to a predetermined electric signal. The calculating section 1-2 generates a voltage corresponding to a frequency driven by the compressor 5 based on "a temperature corresponding to an intake pressure" and "a temperature corresponding to an ejecting pressure" converted to an electric signal by the temperature detectors 2 and 3. The driving circuit 1-3 is used to supply a driving signal of a frequency corresponding to a voltage supplied by the calculating section to the driving section 4 and the driving section 4 is used to drive the compressor 5 with a driving force corresponding to the driving signal.

However, there is a problem in a vibrating compressor made by using conventional techniques that a compression efficiency is lowered due to unstable strokes of a piston caused by changes of a driving force supplied to the compressor by the driving section since there is an error between a true refrigerant temperature representing a refrigerant pressure and a temperature detected by the temperature detector and an input voltage to the driving section changes due to changes of a power voltage, and in some cases, a valve of a cylinder is damaged by a strike of the piston against the valve.

In case of a configuration that an upper dead point reference position of the piston is previously set to a position far from a valve to prevent the valve from being damaged by a strike of the piston, there is a problem that a compression efficiency is further lowered since refrigerant cannot be compressed sufficiently. In addition, there is a problem that a refrigeration capability is reduced due to changes of strokes of the piston caused by changes of a spring coefficient of a mechanical system formed by refrigerant gas and a resonance spring because of changes of an external air temperature, a power voltage, and a load.

Furthermore, there is a problem that an efficiency is further lowered due to a difference between a resonance frequency of the mechanical system formed by the refrigerant gas and the resonance spring and a resonance frequency of an electric system for driving the mechanical system since there is an error between a true refrigerant temperature representing a refrigerant pressure and a temperature detected by a temperature detector.

As another type of a conventional vibrating compressor, there is, for example, a vibrating compressor described in Japanese Utility Model Laid-open No. 2-145679 of 1990. The conventional vibrating compressor will be described referring to FIG. 25.

In FIG. 25, there are shown an alternating power source 41, a variable voltage rectifier 42, a pressure instruction generator 43, a summing amplifier 44, a frequency oscillator 45, a pulse signal generator 46, a orthogonal converter 47, a linear motor 48, a compressor 49, a pressure tank 50, a vibrating compressor 51, and a pressure detector 52.

The alternating power source 41 is used to supply power to the variable voltage rectifier 42 and the variable voltage rectifier 42 is used to supply power to the orthogonal converter 47 on the basis of the power applied by the alternating power supply 41 and a signal given by the pulse signal generator 46. An operation of this type of the conventional vibrating compressor is described below. The pressure instruction generator 43 is used to give a pressure instruction to the summing amplifier 44 and the summing amplifier 44 is used to add a pressure instruction given by the pressure instruction generator 43 to a pressure value detected by the pressure detector 52 to be amplified and to output a signal to the frequency oscillator 45. The frequency oscillator 45 oscillates a frequency based on a signal given by the summing amplifier 44, and the pulse signal generator 46 gives a pulse signal to the orthogonal converter 47 based on a frequency oscillated by the frequency oscillator 45. The orthogonal converter 47 drives the linear motor 48 constituting the vibrating compressor 51 by using power supplied by the variable voltage rectifier 42 based on a signal generated by the pulse signal generator 46.

The compressor 49 takes in refrigerant, compresses it, and ejects it in the pressure tank 50 when the linear motor 48 is driven. The pressure detector 52 detects a pressure of refrigerant ejected from the pressure tank 50 and outputs a signal to the summing amplifier 44. Use of the conventional vibrating compressor is intended to operate the vibrating compressor 51 as expected by controlling frequency oscillated by the frequency oscillator 45 even if there is a difference between a pressure instructed by the pressure instruction generator and a pressure of the pressure tank 50 detected by the pressure detector 52.

The vibrating compressor, however, has a problem that a compression efficiency is reduced due to a difference between an actual operating frequency and a resonance frequency since it cannot detect a change of the resonance frequency of the vibrating compressor caused by a change of load conditions. In addition, there is a problem that a frequency control itself is likely to be uncertain or unstable since there is an error between a true refrigerant pressure and a pressure detected by the pressure detector and a time lag occurs in a detected pressure according to a position at which the pressure detector is installed.

SUMMARY OF THE INVENTION

Accordingly, from the viewpoint of the above problems, it is a first object of the present invention to prevent the compressor from having a reduced compression efficiency and to prevent a valve from being damaged by being struck by a piston by detecting a deviation from a stroke reference value or from an upper dead point reference value when a piston stroke or an upper dead point position changes and controlling a driving force to drive the piston according to the deviation.

This invention provides a vibrating compressor comprising a tubular cylinder having a intake valve and an ejector valve, a piston moving axially in the cylinder, a piston driving section for driving the piston by giving a driving force to the piston, a displacement detecting section connected in an axial direction of the piston for detecting a displacement of the piston and outputting it as a piston position signal, an upper dead point position detecting section for detecting an upper dead point position of the piston based on the piston position signal from the displacement detecting section, and a driving force control section for changing the driving force given to the piston by the piston driving section according to a difference between the upper dead point position and a preset upper dead point position reference value immediately after detecting that the upper dead point position detecting section has detected the upper dead point position, so as to achieve the above first object.

In addition, the present invention provides a vibrating compressor comprising an upper dead point position candidate detecting section for detecting an upper dead point position candidate of a piston based on a piston position signal from a displacement detecting section, an upper dead point position candidate storing section for storing the upper dead point position candidate detected by the upper dead point position candidate detecting section, an upper dead point position determining section for determining an upper dead point position selected out of the upper dead point position candidates stored in the upper dead point position candidate storing section, and a driving force control section for changing a driving force given to the piston by a piston driving section according to a difference between the upper dead point position and a preset upper dead point position reference value immediately after detecting that the upper dead point position determining section has determined the upper dead point position, so as to achieve the above first object.

Furthermore, it is a second object of the present invention to provide a highly efficient vibrating compressor which does not cause over strokes of a piston nor reduce an efficiency even if an external air temperature, a power voltage, or a load changes, and does not have any difference between a resonance frequency of a mechanical system formed by a refrigerant gas and a resonance spring and a resonance frequency of an electrical system for driving the mechanical system.

To achieve the second object, a vibrating compressor according to this invention comprises a tubular cylinder having an intake valve and an ejector valve, magnet arranged around the cylinder, a coil moving in an axial direction of the cylinder with being affected by the magnet, a piston moving axially in the cylinder with being connected to the coil, a resonance spring connected to the piston, a displacement detector connected in an axial direction of the piston, a converter circuit for converting an alternating power to direct power, an inverter circuit for converting direct power to an alternating power by switching transistors and applying a voltage to the coil, an upper dead point position calculation means for calculating an upper dead point position of the piston based on a piston position signal from the displacement detector, and an inverter control means for changing an output voltage of the inverter circuit according to a difference between the upper dead point position and a preset upper dead point reference value.

In addition, the vibrating compressor according to this invention has a stroke calculation means for calculating a stroke of the piston based on a piston position signal from the displacement detector and an inverter control means for changing an output voltage of the inverter circuit according to a difference between the stroke and a preset stroke reference value.

Furthermore, the vibrating compressor according to this invention includes an upper dead point position calculation means for calculating an upper dead point position of the piston based on a piston position signal from the displacement detector, a stroke calculation means for calculating a stroke of the piston based on the piston position signal, and an inverter control means for changing an output voltage amplitude of the inverter circuit according to a difference between the stroke and a preset stroke reference value and for changing an output voltage direct-current component of the inverter circuit according to a difference between the upper dead point position and a preset upper dead point reference value.

Still further, the vibrating compressor according to this invention includes an upper dead point position calculation means for calculating an upper dead point position of the piston based on a piston position signal from the displacement detector, a stroke calculation means for calculating a stroke of the piston based on the piston position signal, a frequency comparison means for detecting a difference between an output frequency of the inverter and a frequency of the piston position signal, and an inverter control means for changing an output voltage amplitude of the inverter circuit according to a difference between the stroke and a preset stroke reference value and changing a direct-current voltage component of the inverter circuit according to a difference between the upper dead point position and a preset upper dead point reference value and for dissolving a difference between an output frequency of the inverter circuit and a frequency of the piston position signal by changing the output frequency of the inverter circuit.

This configuration is effective for preventing the piston from having over strokes by always keeping the upper dead point of the piston in a reference position with changing an output voltage of the inverter circuit according to a difference between the upper dead point position and the upper dead point reference value even at a change of an external condition such as an external air temperature, a power voltage, or a load. In addition, the above configuration is effective for preventing a refrigerating capability from being reduced by always keeping strokes of the piston in a certain level by changing an output voltage amplitude of the inverter circuit according to a difference between the stroke and the stroke reference value even at a change of an external condition such as an external air temperature, a power voltage, and a load.

Furthermore, the above configuration is effective for preventing the piston from having over strokes and a refrigerating capability from being reduced by always keeping the upper dead point to the same position by keeping the strokes of the piston in a certain level by changing an output voltage amplitude of the inverter circuit according to a difference between the stroke and the stroke reference value and by changing an output voltage direct-current component of the inverter circuit according to a difference between the upper dead point position and the upper dead point reference value even at a change of an external condition.

Still further, the configuration is effective for preventing the piston from having over strokes by keeping the strokes of the piston in a certain level with changing an output voltage amplitude of the inverter circuit according to a difference between the stroke and the stroke reference value and by always keeping the upper dead point in the same position with changing an output voltage direct-current component of the inverter circuit according to a difference between the upper dead point position and the upper dead point reference value even at a change of an external condition and by dissolving a difference between an output frequency of the inverter circuit and a frequency of the piston position signal with changing an output frequency of the inverter circuit and effective for always keeping the compressor having the highest efficiency by matching a resonance frequency of the mechanical system formed by a refrigerant gas and a resonance spring with a resonance frequency of the electrical system for driving the mechanical system.

Furthermore, from a viewpoint of the above problems, it is a third object of the present invention to prevent the compressor from having a reduced compression efficiency by detecting a current value or an amplitude value of the piston required for driving the piston of the compressor with changing a driving frequency even if a resonance frequency of the vibrating compressor is changed by a change of a load condition or the like and by driving the piston at a resonance frequency detected based on the changes so that the compressor can be running at the resonance frequency.

To achieve the above third object, the present invention provides a vibrating compressor comprising a tubular cylinder having an intake valve and an ejector valve, a piston moving axially in the cylinder, a piston driving section for driving the piston by applying an alternating voltage to the piston as a piston driving force, a resonance spring connected to the piston, a driving force detecting section for detecting a current value of the piston driving force supplied to the piston by the piston driving section, a displacement detecting section for detecting a displacement of the piston and for outputting it as a piston position signal with being connected in an axial direction of the piston, a frequency detecting section for detecting a frequency of a reciprocating motion of the piston based on the piston position signal from the displacement detecting section, and a control section for achieving a frequency of the piston driving force supplied to the piston by the piston driving section by stepwise increasing or decreasing a frequency of the piston driving force given from the piston driving section to the piston at certain time intervals by certain amounts to determine a frequency detected by the frequency detecting section when a current value detected by the driving force detecting section becomes the minimum as a resonance frequency of the piston and the resonance spring.

In addition, to achieve the above third object, the present invention provides a vibrating compressor comprising a tubular cylinder having an intake valve and an ejector valve, a piston moving axially in the cylinder, a piston driving section for driving the piston by applying an alternating voltage to the piston as a piston driving force, a resonance spring connected to the piston, a driving force detecting section for detecting a current value of the piston driving force supplied to the piston by the piston driving section, a displacement detecting section for detecting a displacement of the piston and for outputting it as a piston position signal with being connected in an axial direction of the piston, a frequency detecting section for detecting a frequency of a reciprocating motion of the piston based on the piston position signal from the displacement detecting section, and a control section for achieving a frequency of the piston driving force supplied to the piston by the piston driving section by increasing or decreasing a frequency of the piston driving force given to the piston by the piston driving section at certain time intervals by certain amounts and, if a current value detected by the driving force detecting section after the frequency is increased or decreased is smaller than that before it is increased or decreased, considering the frequency of the smaller current value obtained after increasing or decreasing the frequency as a frequency of the piston driving force supplied by the piston driving section and repeating an increase or decrease of the frequency until a current value detected by the driving force detecting section before an increase or decrease of the frequency becomes smaller than that after the increase or decrease of the frequency to the piston to determine the frequency detected by the frequency detecting section as a resonance frequency of the piston and the resonance spring.

Accordingly, the vibrating compressor according to this invention has the above configuration in which the piston driving section applies an alternating voltage to the piston moving axially in the tubular cylinder having the intake valve and the ejector valve as a piston driving force, the driving force detecting section detects a current value of the piston driving force supplied to the piston by the piston driving section, the displacement detecting section detects a displacement of the piston and outputs it as a piston position signal, the frequency detecting section detects a frequency of a reciprocating motion of the piston based on the piston position signal from the displacement detecting section, and the control section achieves a frequency of the piston driving force supplied to the piston by the piston driving section by stepwise increasing or decreasing a frequency of the piston driving force given to the piston by the piston driving section at certain time intervals by certain amounts to determine a frequency detected by the frequency detecting section when a current value detected by the driving force detecting section becomes the minimum as a resonance frequency of the piston and the resonance spring.

In addition, in the vibrating compressor according to this invention, the piston driving section applies an alternating voltage to the piston moving axially in the tubular cylinder having the intake valve and the ejector valve as a piston driving force, the driving force detecting section detects a current value of the piston driving force supplied to the piston by the piston driving section, the displacement detecting section detects a displacement of the piston and outputs it as a piston position signal, the frequency detecting section detects a frequency of a reciprocating motion of the piston based on the piston position signal from the displacement detecting section, and the control section achieves a frequency of the piston driving force supplied to the piston by the piston driving section by increasing or decreasing a frequency of the piston driving force given to the piston by the piston driving section at certain time intervals by certain amounts and, if a current value detected by the driving force detecting section after the frequency is increased or decreased is smaller than that before it is increased or decreased, considering the frequency of the smaller current value obtained after increasing or decreasing the frequency as a frequency of the piston driving force supplied by the piston driving section and repeating an increase or decrease of the frequency until a current value detected by the driving force detecting section before an increase or decrease of the frequency becomes smaller than that after the increase or decrease of the frequency to the piston to determine the frequency detected by the frequency detecting section as a resonance frequency of the piston and the resonance spring.

BRIEF DESCRIPTION OF THE DRAWINGS

FIG. 20 is a stored status diagram illustrating a state that a control section of the sixth embodiment of the present invention stores frequencies and current values;

DETAILED DESCRIPTION OF THE INVENTION

Preferred embodiments of this invention are described below by using the accompanying drawings.

(First embodiment)

Figure 1:
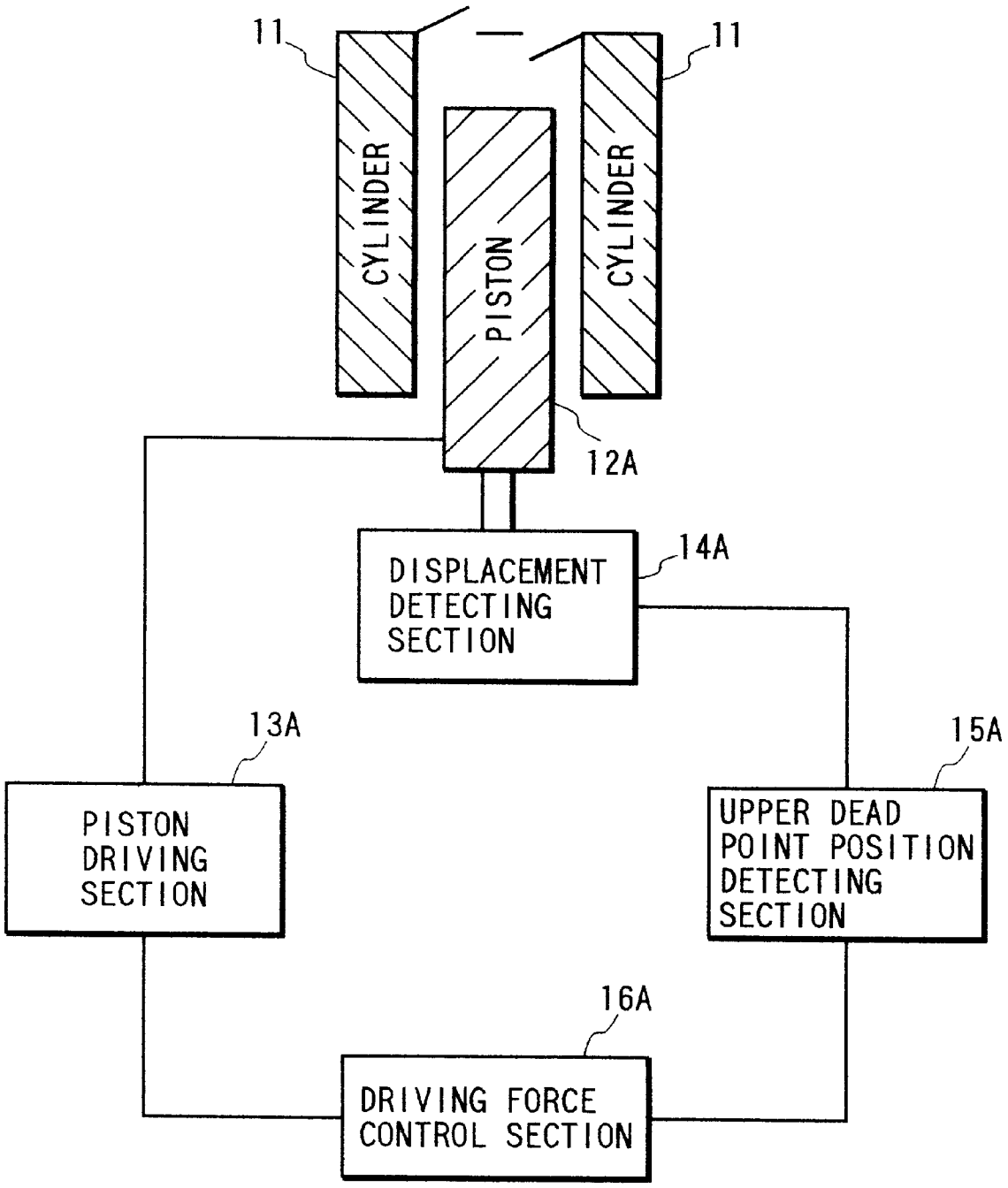
FIG. 1 is a configuration diagram illustrating a vibrating compressor of a first embodiment of the present invention.
Figure 2:
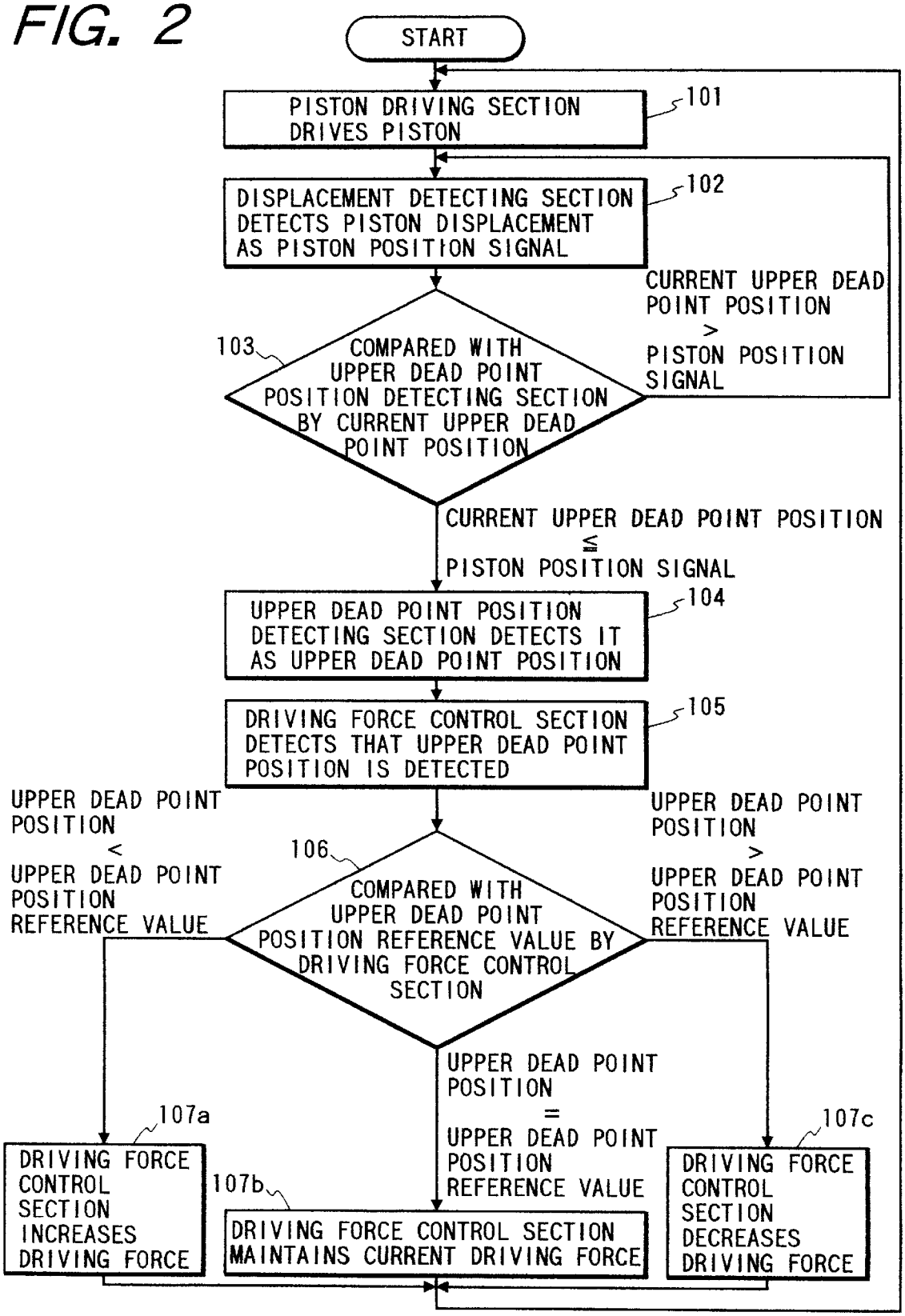
FIG. 2 is a flowchart illustrating an operation of the first embodiment of the present invention.
Figure 3:
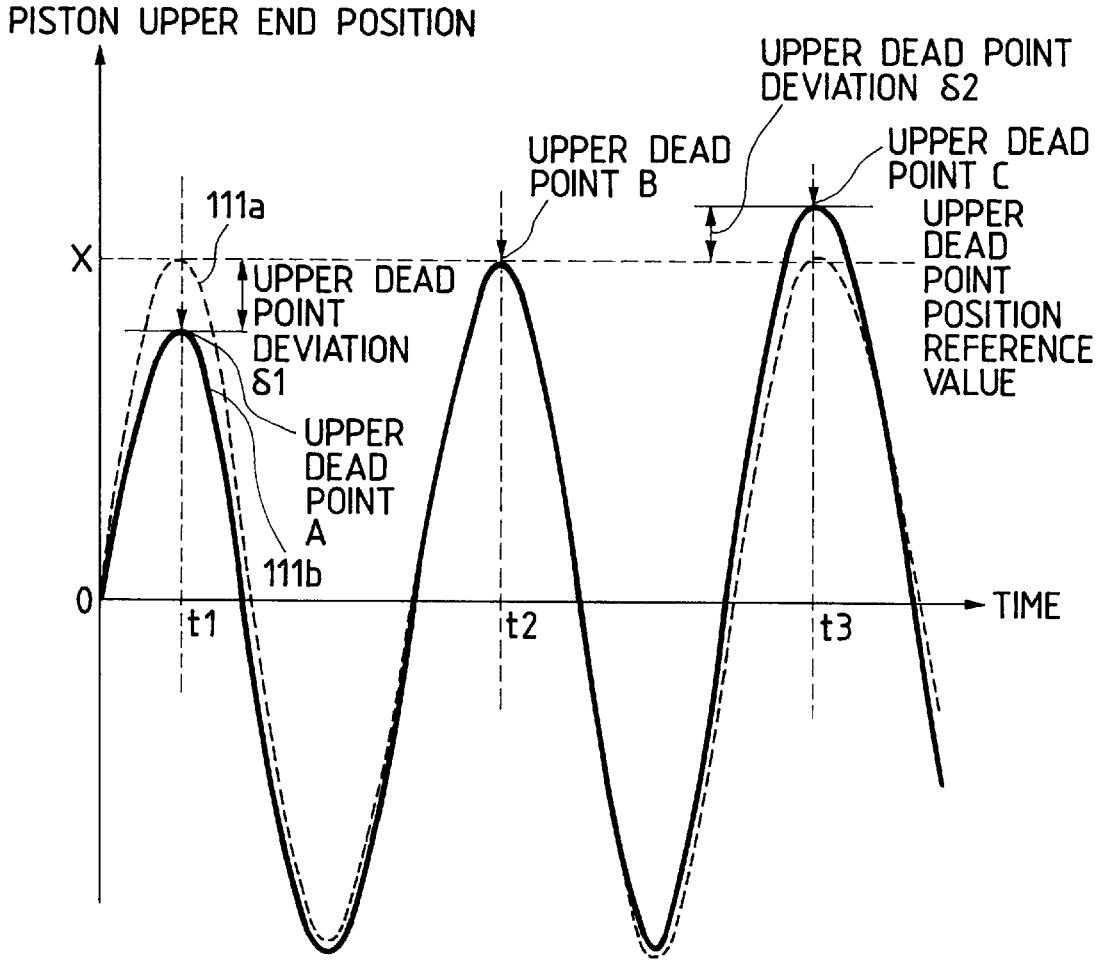
FIG. 3 is a timing diagram illustrating an operation of the first embodiment of the present invention.

Referring to FIG. 1, there is shown a configuration diagram of a vibrating compressor according to a first embodiment of the present invention. FIGS. 2 and 3 show a flowchart illustrating an operation of the embodiment and a timing diagram of the embodiment, respectively. Referring to FIG. 1, there are shown a cylinder 11, a piston 12A, a piston driving section 13A, a displacement detecting section 14A, an upper dead point position detecting section 15A, and a driving force control section 16A. In this drawing, the piston 12A moves axially in the cylinder 11 with the help of a driving force from the piston driving section 13A. The displacement detecting section 14A comprises a differential transformer and it is connected in an axial direction of the piston 12A to detect a displacement of the piston 12A as a piston position signal such as an output voltage value of the differential transformer.

The upper dead point position detecting section 15A compares a piston upper end position with the current upper dead point position based on the position signal of the piston 12A detected by the displacement detecting section 14A and detects a point nearer to a valve installed in the cylinder 11 as an upper dead point position of the piston 12A. The driving force control section 16A detects that the upper dead point position detecting section 15A has detected an upper dead point position and immediately compares the upper dead point position detected by the upper dead point position detecting section 15A with a preset upper dead point position reference value, and then changes a driving force given to the piston 12A by the piston driving section 13A according to each deviation, for example, by increasing the driving force given to the piston 12A by 1 V by the piston driving section 13A if the upper dead point position is 1 mm smaller than the upper dead point position reference value as the deviation. Although "an increase of 1 V" is given for "a lack of 1 mm" in the above example as a change rate of a driving force supplied to the piston 12A by the piston driving section 13A for a deviation between an upper dead point position and an upper dead point position reference value, the change rate is not limited to the values, but an arbitrary unit representing a change of a driving force can be associated with an arbitrary unit representing a deviation such as "an attenuation of 5 N" for "an excess of 0.1 mV."

Referring to FIG. 3, a thick dashed line 111(*a*) indicates an expected value of a track of a piston upper end position and a thick solid line 112(*b*) indicates a track of an actual piston upper end position. A concrete example of an operation of a vibrating compressor of this embodiment having the above configuration is described below by using a flowchart in FIG. 2 and a timing diagram in FIG. 3.

The piston driving section 13A drives the piston 12A with a preset driving force (step 101). The displacement detecting section 14A detects a displacement of the piston 12A as a piston position signal (step 102). The upper dead point position detecting section 15A compares a piston position signal detected by the displacement detecting section 14A with the current upper dead point position (step 103).

If the current upper dead point position is greater than the piston position indicated by the piston position signal as a result of the comparison in the step 103, the steps 102 and 103 are executed repeatedly, and if the piston position indicated by the piston position signal is equal to or greater than the current upper dead point position, a point obtained based on the piston position signal is detected as the current upper dead point position (step 104). The driving force control section 16A detects that the upper dead point position detecting section 15A has detected an upper dead point based on an electrical signal (step 105). The driving force control section 16A compares a preset upper dead point position reference value (X in FIG. 3) with an upper dead point position detected by the upper dead point position detecting section 15A (step 106).

If the upper dead point position does not reach the upper dead point position reference value as a result of the comparison in the step 106, the driving force control section 16A increases a driving force of the piston driving section 13A according to a difference between the upper dead point position and the upper dead point position reference value (an upper dead point deviation d1 in FIG. 3) immediately after detecting that the upper dead point position detecting section 15A has detected an upper dead point position (t1 in FIG. 3) (step 106(*a*)).

If the upper dead point position is equal to the upper dead point position reference value (t2 in FIG. 3), the driving force control section 16A keeps the current driving force (step 106(*b*)), and if the upper dead point position exceeds the upper dead point position reference value, the driving force control section 16A detects that the upper dead point position detecting section 15A has detected an upper dead point position (t3 in FIG. 3) and then immediately attenuates a driving force of the piston driving section 13A according to a difference between the upper dead point position and the upper dead point position reference value (an upper dead point deviation d2 in FIG. 3) (step 106(*c*)).

As described in the above, the vibrating compressor of the first embodiment includes the displacement detecting section 14A connected in an axial direction of the piston 12A, the upper dead point position detecting section 15A for detecting an upper dead point position of the piston based on a piston position signal from the displacement detecting section 14A, and the driving force control section 16A for changing a driving force given to the piston 12A by the piston driving section 13A according to a difference between the upper dead point position and a preset upper dead point position reference value immediately after detecting that the upper dead point position detecting section 15A has detected the upper dead point position, therefore, even if a difference is made between the upper dead point position and the upper dead point position reference value when external conditions such as a temperature condition and a pressure condition, a compression efficiency is not reduced and a valve installed in the cylinder 11 is prevented from being damaged by being struck by the piston 12A by always keeping the upper dead point position of the piston 12A at the upper dead point position reference value with changing a driving force of the piston driving section 13A according to a difference between the upper dead point position and the upper dead point position reference value immediately after detecting the upper dead point position.

(Second embodiment)

Figure 4:
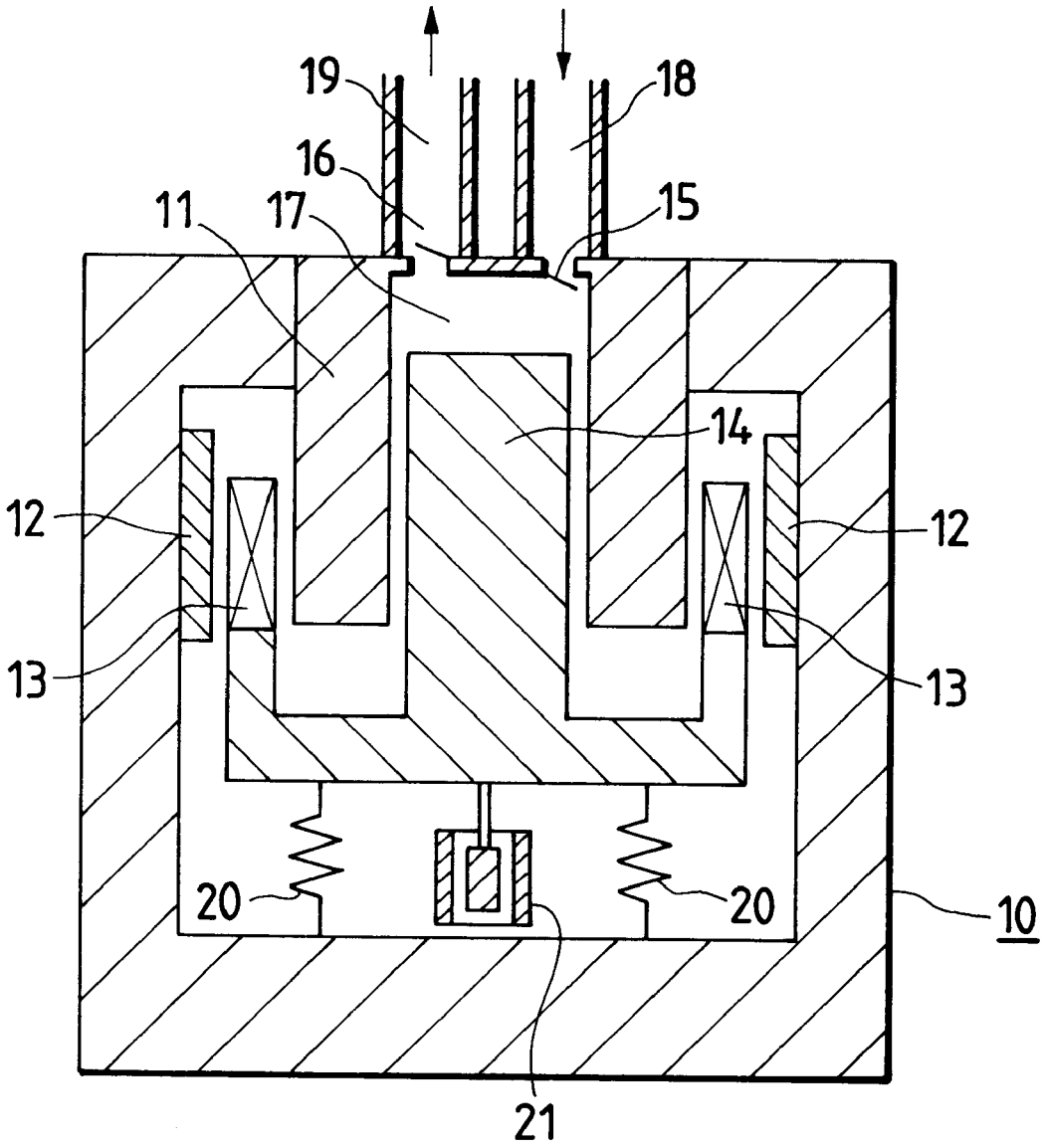
FIG. 4 is a cross section of a vibrating compressor of a second embodiment of the present invention.
Figure 5:
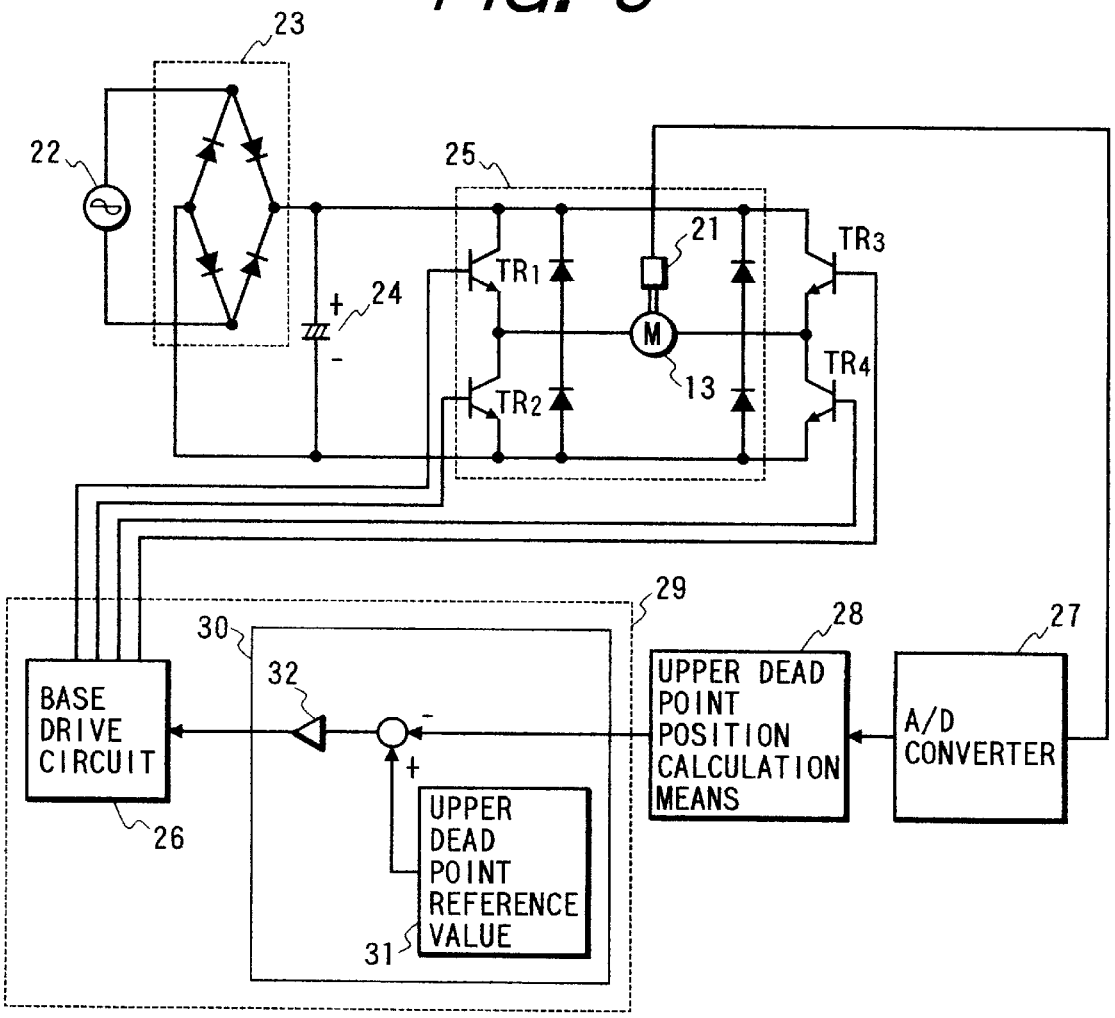
FIG. 5 is an electric circuit diagram of a device of the second embodiment of the present invention.
Figure 6:
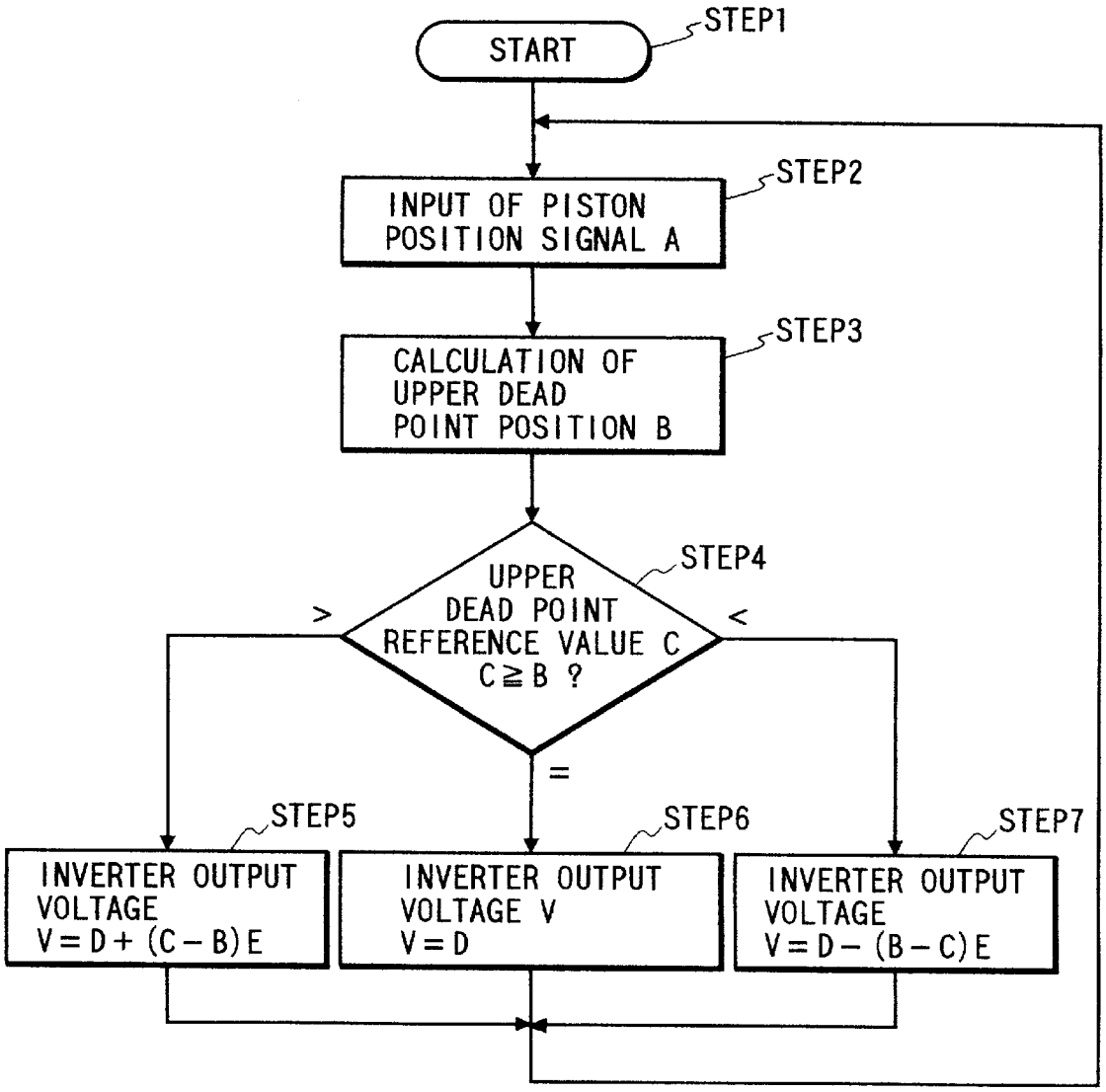
FIG. 6 is a flowchart of an operation of the second embodiment of the present invention.
Figure 7:
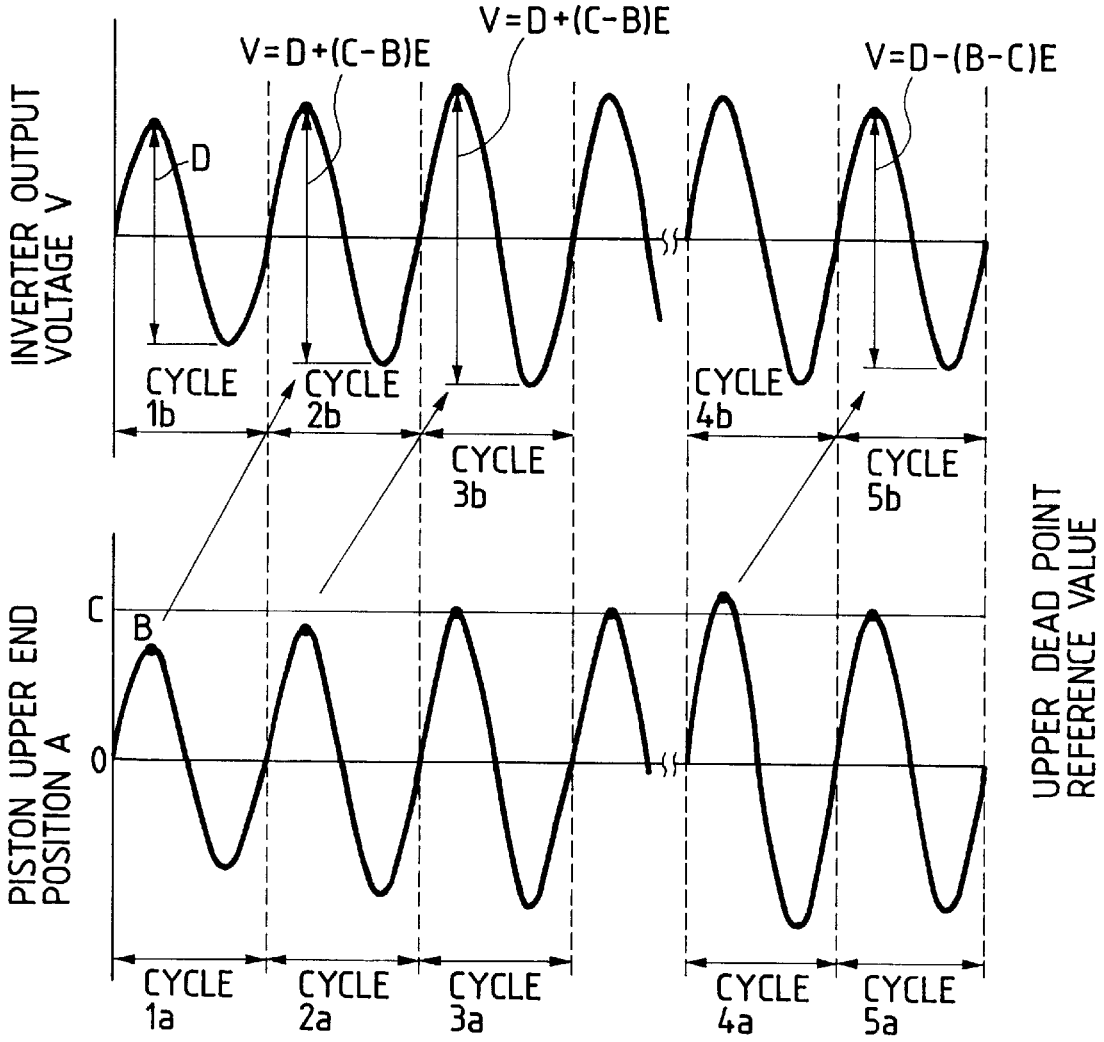
FIG. 7 is a timing diagram of an operation of the second embodiment of the prevent invention.

FIG. 4 shows a cross section of a vibrating compressor according to a second embodiment of this invention, and FIGS. 5, 6, and 7 are an electrical circuit diagram, a flowchart showing operation, and a timing diagram of the operation of the embodiment, respectively. Referring to FIG. 4, a tubular cylinder 11 is installed at a center of a vibrating compressor 10 and pieces of permanent magnet 12 are arranged in a circle around the cylinder 11. A circular coil 13 is installed between the permanent magnet 12 and the cylinder 11 and the coil 13 is movable in an axial direction of the cylinder 11 with an interaction between the permanent magnet 12 and itself.

A compression piston 14, which is contained in the cylinder 11, forms a pressing chamber 17 having an intake valve 15 and an ejector valve 16 and it is connected with the coil 13, so that it moves axially in the cylinder 11. In addition, the intake valve 15 and the ejector valve 16 are connected with an intake pipe 18 and an ejector pipe 19, respectively. Furthermore, there are a resonance spring 20 and a displacement detector 21 comprising a working transformer connected in an axial direction of the piston 14. A magnetic field caused by the permanent magnet 12 is formed between the permanent magnet 12 and the cylinder 11. When an alternating current is supplied to the coil 13 arranged between them, a thrust vibrating according to a frequency of the supplied alternating current is applied to the coil 13 to drive the piston connected with the coil 13 axially.

Referring next to an electric circuit in FIG. 5, there is shown a commercial alternating current 22, which is connected to an alternating input section of a converter circuit 23 for converting an alternating current to a direct current. An anode of a direct current output section of the converter circuit 23 is connected to an anode of an electrolytic capacitor 24, collectors of transistors TR1 and TR3 in the inverter circuit 25. A cathode of the direct current output section of the converter circuit 23 is connected to a cathode of the electrolytic capacitor 24, emitters of transistors TR2 and TR4 in the inverter circuit 25.

In the inverter circuit 25, an emitter of the TR1 is connected to a collector of the TR2, an emitter of the TR3 is connected to a collector of the TR4, and then the coil 13 of the vibrating compressor 10 is connected between the emitter of the TR1 and the emitter of the TR3. A pair of the TR1 and the TR4 and that of the TR3 and the TR2 repeat setting of the ON and OFF states alternately based on a signal from the base drive circuit 26. The displacement detector 21 comprises a working transformer connected in an axial direction of the piston 14, and an analog position signal of the piston 14 from the displacement detector 21 is converted to a digital signal via an A–D converter 27 and entered to an upper dead point position calculation means 28. An output of the upper dead point position calculation circuit 28 is connected to an amplitude control means 30 in an inverter control means 29 and an output of the amplitude control means 30 is connected to a base drive circuit 26.

The amplitude control means 30 comprises an amplifier 32 which compares an upper dead point position signal from the upper dead point position calculation means 28 with an upper dead point reference value 31 stored in a memory (not shown) in the inverter control means 29 and changes an output voltage amplitude for the base drive circuit 26 in proportion to a difference between them.

An operation of the vibrating compressor having the above configuration is explained below by using a flowchart in FIG. 6 and a timing diagram in FIG. 7. In step 1, a commercial alternating power supply 22 is turned on. The electrolytic capacitor 24 is charged via the converter circuit 23 to supply direct power to the inverter circuit 25. Then, inverter waveforms are output from the base drive circuit 26 and the pair of the TR1 and the TR4 and the pair of the TR3 and the TR2 in the inverter circuit 25 repeat setting of the ON and OFF states alternatively.

Power converted from a direct current to an alternating current is supplied from the inverter circuit 25 to the coil 13 of the vibrating compressor 10, the vibrating compressor 10 starts the operation, and then the piston 14 connected to the coil 13 vibrates in an axial direction of the cylinder 11 according to a frequency of the supplied alternating current and refrigerant is compressed in the pressing chamber 17. In step 2, an analog position signal of the piston 14 from the displacement detector 21 is converted to a digital signal via the A–D converter 27 and it is entered into the upper dead point position calculation means 28. This signal indicates an upper position of the piston 14 facing the pressing chamber 17. Considering the signal as A, A is set to 0 immediately after the power supply is turned on.

In step 3 next, an upper dead point position B which is the maximum value of an upper end position of the piston 14 is calculated as shown in cycle 1*a* in FIG. 7 in the upper dead point position calculation means 28. In step 4, an upper dead point position B is compared with a preset upper dead point reference value C in an amplitude control means 30 in the inverter control means 29. If the upper dead point reference value C is greater than the upper dead point position B, processing proceeds to step 5 and an inverter output voltage V is increased to a level which is the current output voltage D plus (C–B) times a unit voltage E as shown in cycle 2*b* in FIG. 7 according to a difference between the upper dead point reference value C and the upper dead point position B. If the upper dead point reference value C is the same as the upper dead point position B, processing proceeds to step 6 and the inverter output voltage V keeps the current output voltage D.

If the upper dead point reference value C is smaller than the upper dead point position B, processing proceeds to step 7 and the inverter output voltage V is decreased to a level which is the current output voltage D minus (B–C) times the unit voltage E according to a difference between the upper dead point position B and the upper dead point reference value C.

Immediately after the power supply is turned on, processing in the steps 2, 3, 4, and 5 are repeated to increase the inverter output voltage gradually. As the inverter output voltage is increased, a piston stroke becomes larger. Then, if the upper dead point position B of the piston is equal to the upper dead point reference value C as shown in cycle 3*a*, processing proceeds to step 6 and the inverter output voltage is kept to the same voltage. Accordingly, the same voltage is supplied to the coil 13 and the piston 14 continues a stable operation.

If an external condition is changed, for example, if an external temperature is rapidly decreased, a pressure in the pressing chamber 17 is decreased, and a piston position moves upwardly due to a stronger resonance spring in a viewpoint of a balance between a gas spring in the pressing chamber 17 and the resonance spring 20. In other words, the upper dead point position B becomes greater than the upper dead point reference value C as shown in cycle 4*a*.

Then, processing proceeds from the step 4 to the step 7 to decrease the inverter output voltage V to a level which is the current output voltage D minus (B–C) times the unit voltage E as shown in cycle 5*a* according to a difference between the upper dead point position B and the upper dead point reference value C. Again, the same voltage is supplied to the coil 13 and the piston 14 continues a stable operation.

As described above, the vibrating compressor of the second embodiment comprises the displacement detector 21 connected in an axial direction of the piston 14, the converter circuit 23 for converting an alternating current to a direct current, the inverter circuit 25 for converting a direct current to an alternating current by switching transistors and applying a voltage to the coil, the upper dead point position calculation means 29 for calculating an upper dead point position of the piston based on a piston position signal from the displacement detector 21, and the amplitude control means 30 for changing an output voltage of the inverter circuit 25 according to a difference between the upper dead point position and a preset upper dead point reference value, therefore, it does not cause any over strokes of the piston 14 by always keeping the upper dead point of the piston 14 to the reference value with changing an output voltage of the inverter circuit 25 according to a difference between the upper dead point position and the upper dead point reference value even if an external condition changes.

Accordingly, it does not cause a damage of the intake valve 15 not the ejector valve 16 in the cylinder 11 due to striking of the piston 14 against the top of the cylinder 11.

(Third embodiment)

Figure 8:
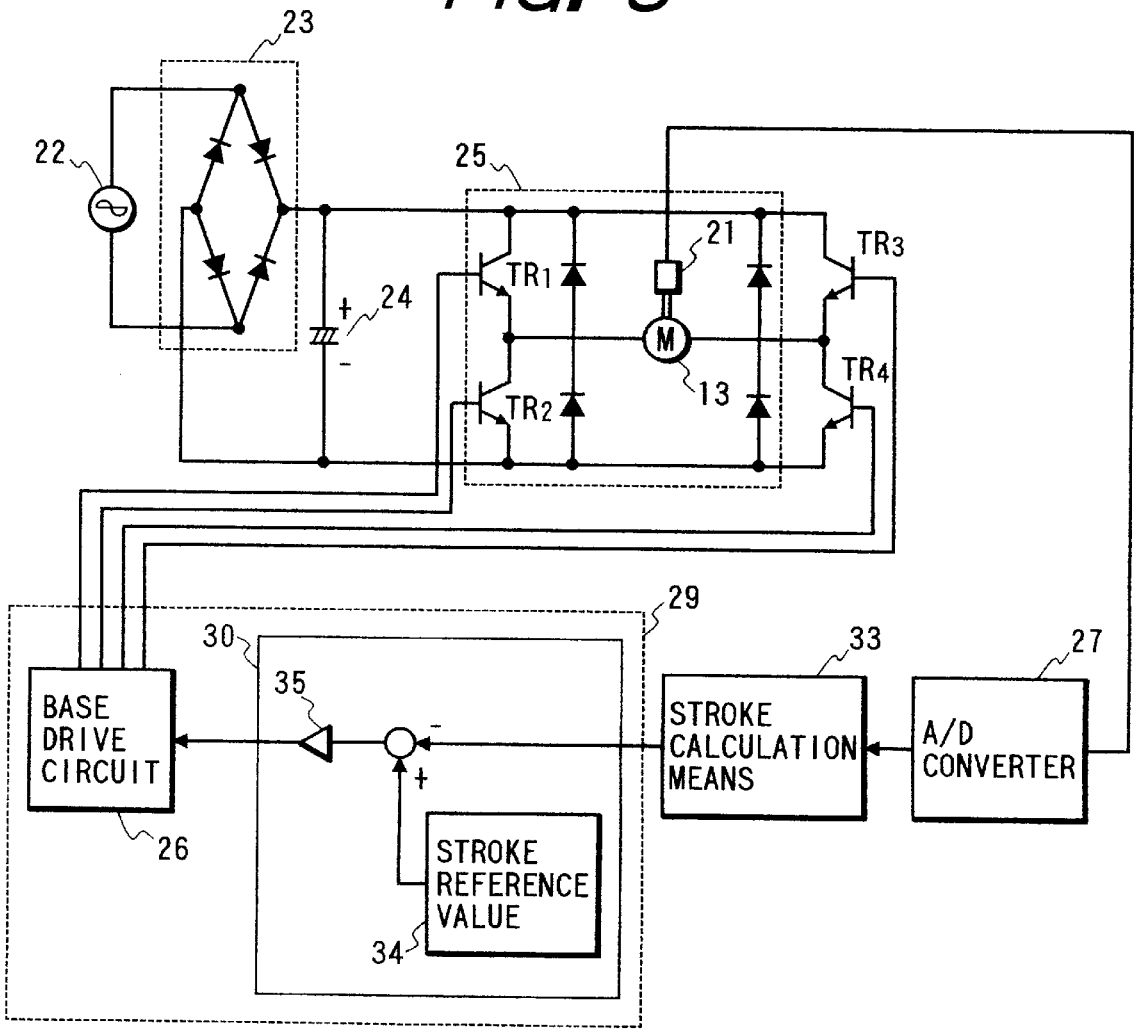
FIG. 8 is an electrical circuit diagram of a third embodiment of the present invention.
Figure 9:
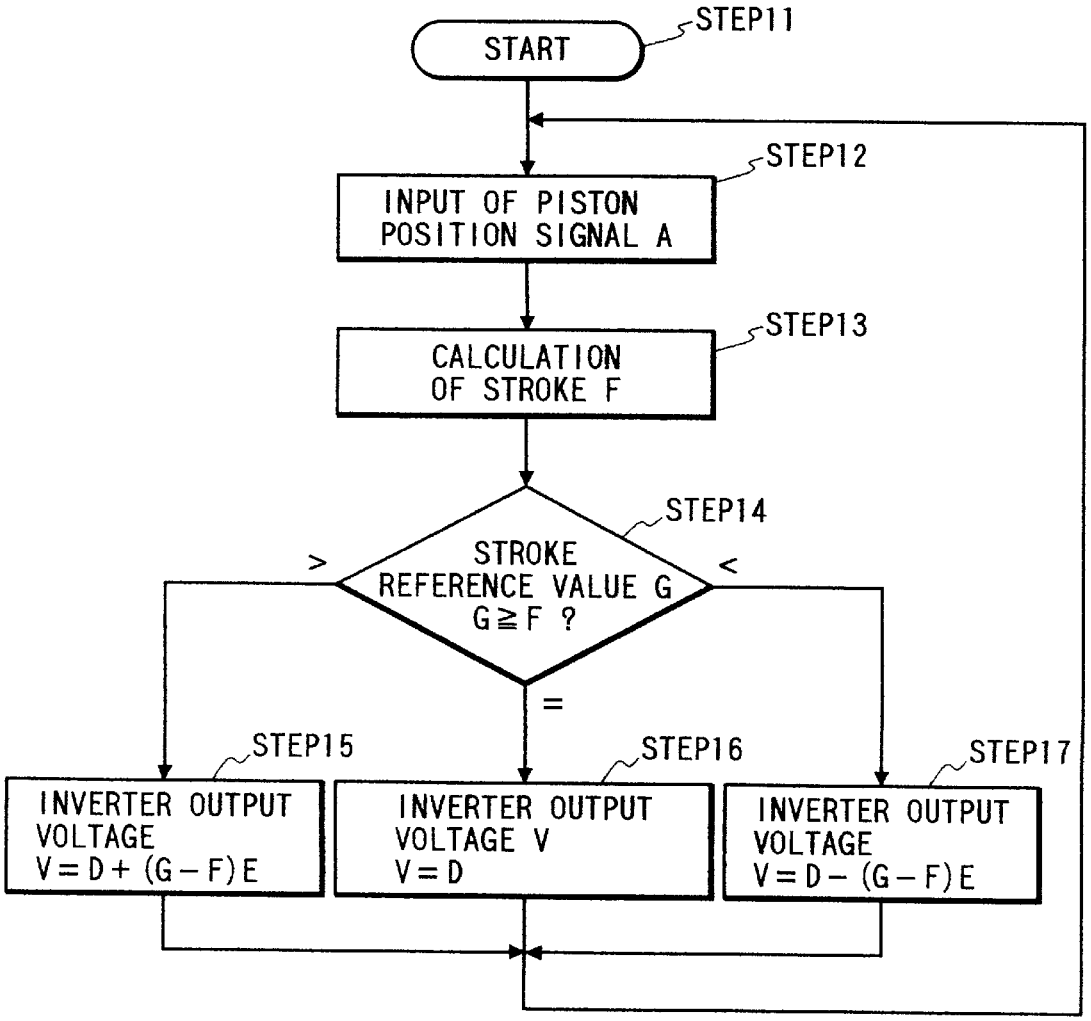
FIG. 9 is a flowchart of an operation of the third embodiment of the present invention.
Figure 10:
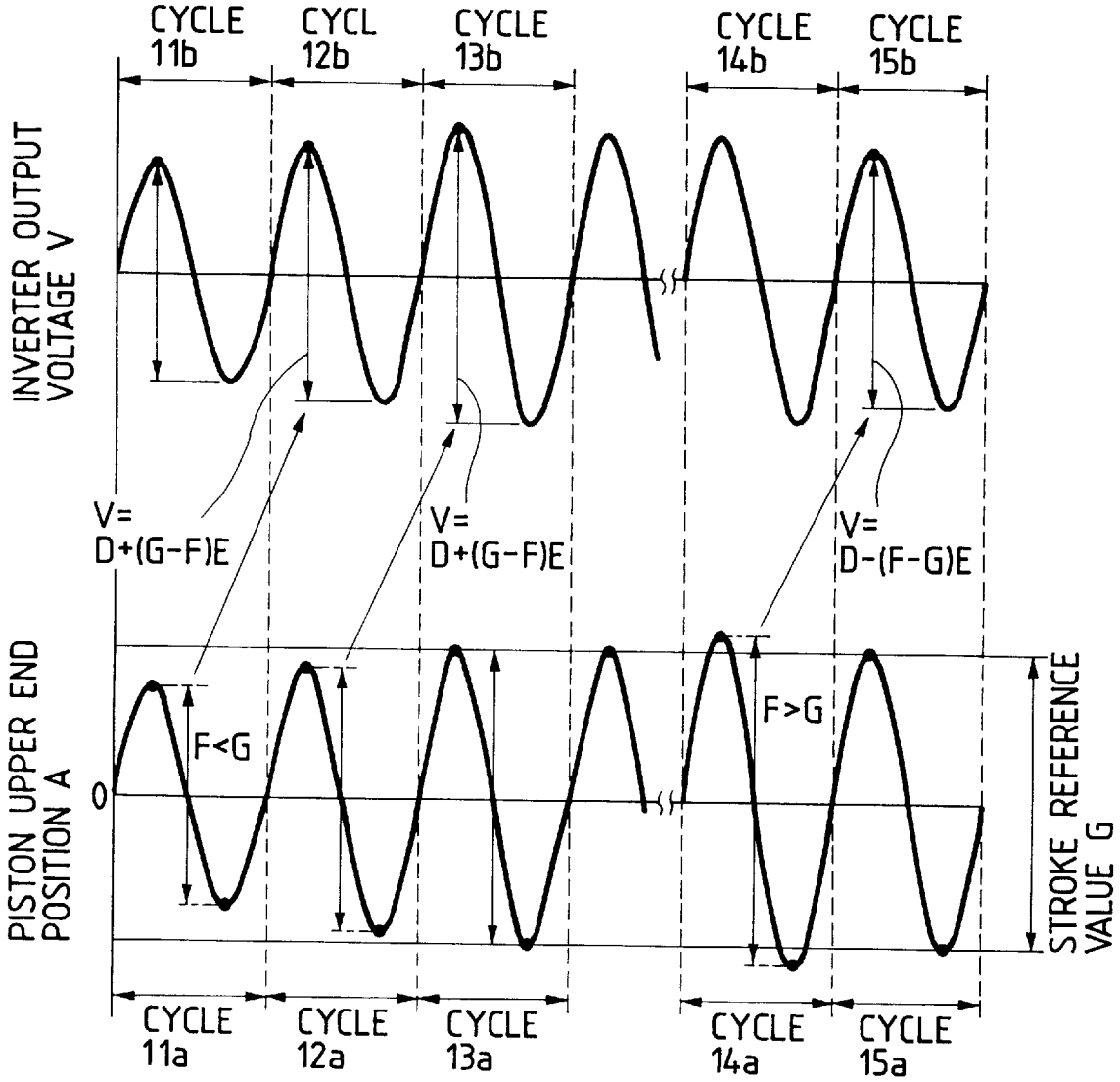
FIG. 10 is a timing diagram of an operation of the third embodiment of the present invention.

Next, a third embodiment according to the present invention is described below by using attached drawings. For the same configurations as for the second embodiment, the same reference numerals are used and their detailed explanation is omitted. FIG. 8 shows an electrical circuit diagram in the third embodiment, FIG. 9 shows an operational flowchart in the third embodiment, and FIG. 10 shows an operational timing diagram in the third embodiment. Then, the electrical circuit in FIG. 8 is described below. An analog position signal of a piston 14 from a displacement detector 21 is converted to a digital signal via an A–D converter 27 and it is entered into a stroke calculation circuit 33. An output of the stroke calculation means 33 is connected to an amplitude control means 30 in an inverter control means 29 and an output of the amplitude control means 30 is connected to a base drive circuit 26.

The amplitude control means 30 comprises an amplifier 35 for changing an output voltage to the base drive circuit 26 in proportion to a difference between a stroke signal from the stroke calculation circuit 33 and a stroke reference value 34 stored in a memory (now shown) in the inverter control means 29 obtained by comparison.

An operation of a vibrating compressor having the above configuration is described below based on the flowchart in FIG. 9 and the timing diagram in FIG. 10. In step 11, a commercial alternating power supply 22 is turned on. Then, an electrolytic capacitor 24 is charged via a converter circuit 23 and direct power is supplied to an inverter circuit 25. An inverter waveform is output from the base drive circuit 26 and a pair of TR1 and TR4 and another pair of TR3 and TR2 of the inverter circuit 25 repeat setting or resetting of the ON or OFF state alternately.

Then, after power converted from a direct current to an alternating current is supplied from the inverter circuit 25 to a coil 13 of the vibrating compressor 10, the vibrating compressor 10 starts running and the piston 14 connected to the coil 13 vibrates in an axial direction of the cylinder 11 according to a frequency of the supplied alternating current to compress refrigerant in the pressing chamber 17. In step 12, an analog position signal of the piston 14 from the displacement detector 21 is converted to a digital signal via the A–D converter 27 and it is entered into the stroke calculation circuit 33. This signal indicates an upper end position of the piston 14 facing the pressing chamber 17 and it is considered as A. Immediately after the power supply is turned on, A is set to 0. Next, in step 13, a stroke F of the piston 14 is calculated based on the maximum value and the minimum value of the upper end position of the piston 14 as shown in a cycle 11*a* in FIG. 10 in the stroke calculation means 33.

In step 14, a stroke F is compared with a preset stroke reference value G in an amplitude control means 30 in the inverter control means 29. If the stroke reference value G is greater than the stroke F, processing proceeds to step 15 and an inverter output voltage V is increased to a level which is the current output voltage D plus (G–F) times a unit voltage E as shown in cycle 12*b* according to a difference between the stroke reference value G and the stroke F. If the .stroke reference value G is the same as the stroke F, processing proceeds to step 16 and the inverter output voltage V keeps the current output voltage D. If the stroke reference value G is smaller than the stroke F, processing proceeds to step 17 and the inverter output voltage V is decreased to a level which is the current output voltage D minus (F–G) times the unit voltage E according to a difference between the stroke F and the stroke reference value G.

Immediately after the power supply is turned on, processing in the steps 12, 13, 14, and 15 are repeated to increase the inverter output voltage gradually. As the inverter output voltage is increased, a piston stroke is extended. Then, if the stroke F of the piston is equal to the stroke reference value G as shown in cycle 13*a*, processing proceeds to step 16 and the inverter output voltage is kept to the same voltage level. Accordingly, the same voltage is supplied to the coil 13 and the piston 14 continues a stable operation.

If an external condition is changed, for example, if an external temperature is rapidly decreased, a pressure in the pressing chamber 17 is decreased, and the piston stroke F is extended due to a stronger resonance spring 20 in a viewpoint of a balance between a gas spring in the pressing chamber 17 and the resonance spring 20. In other words, the stroke F becomes greater than the stroke reference value G as shown in cycle 14*a*. Then, processing proceeds from the step 14 to the step 17 to decrease the inverter output voltage V to a level which is the current output voltage D minus (F–G) times the unit voltage E as shown in cycle 15*a* according to a difference between the stroke F and the stroke reference value G. Again, the piston 14 continues a stable operation in which the stroke F matches the stroke reference value G.

As described above, the vibrating compressor of the third embodiment comprises the stroke calculation means 33 for calculating a stroke of the piston based on a piston position signal from the displacement detector 21 and the amplitude control means 30 for changing an output voltage of the inverter circuit 25 according to a difference between the stroke F and a preset stroke reference value G, therefore, it does not cause any changes of its refrigerating capability by always keeping the stroke of the piston 14 to a certain level with changing an output voltage of the inverter circuit 25 according to a difference between the stroke and the stroke reference value even if an external condition changes.

(Fourth embodiment)

Figure 11:
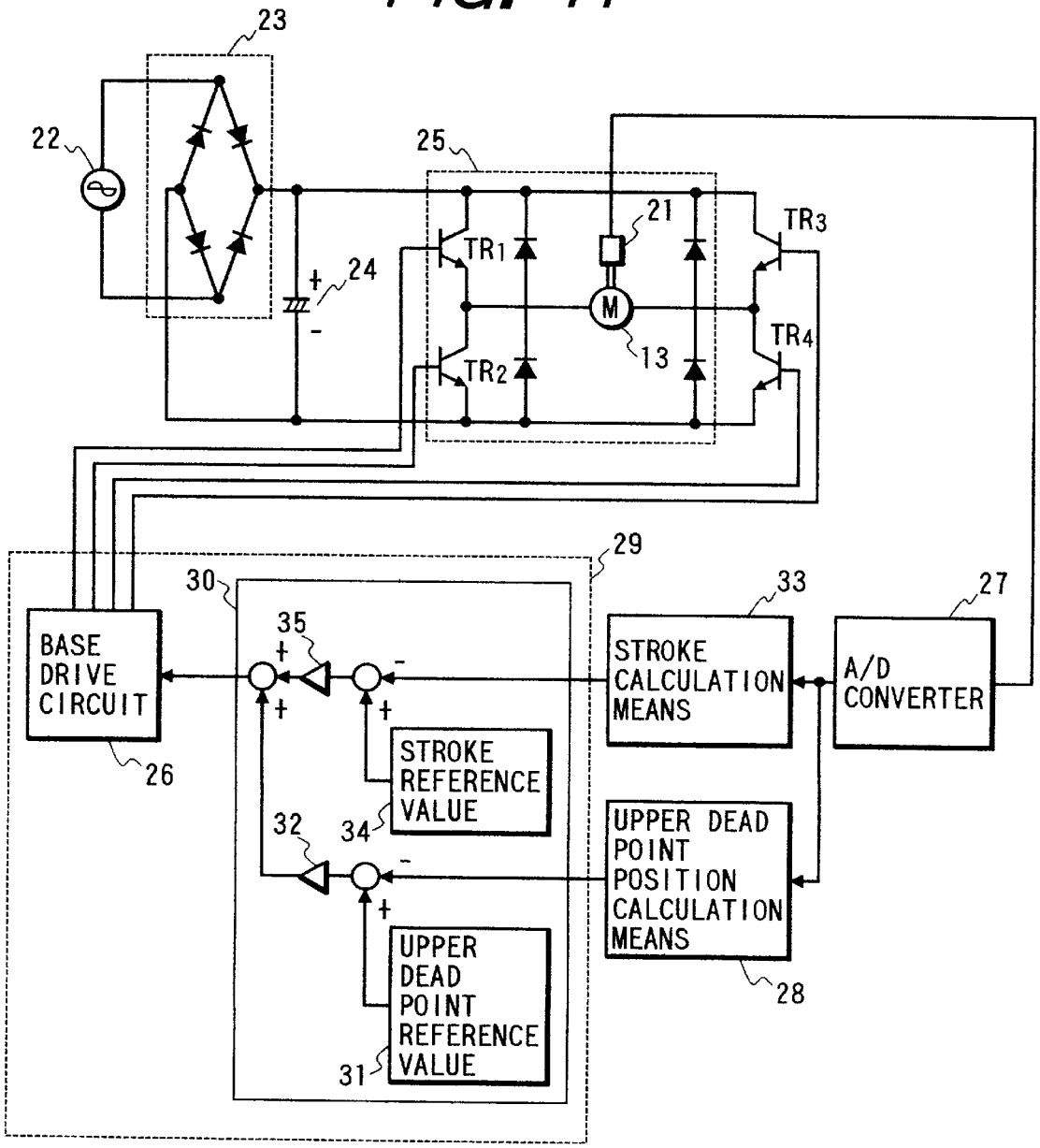
FIG. 11 is an electrical circuit diagram of a fourth embodiment of the present invention.
Figure 12:
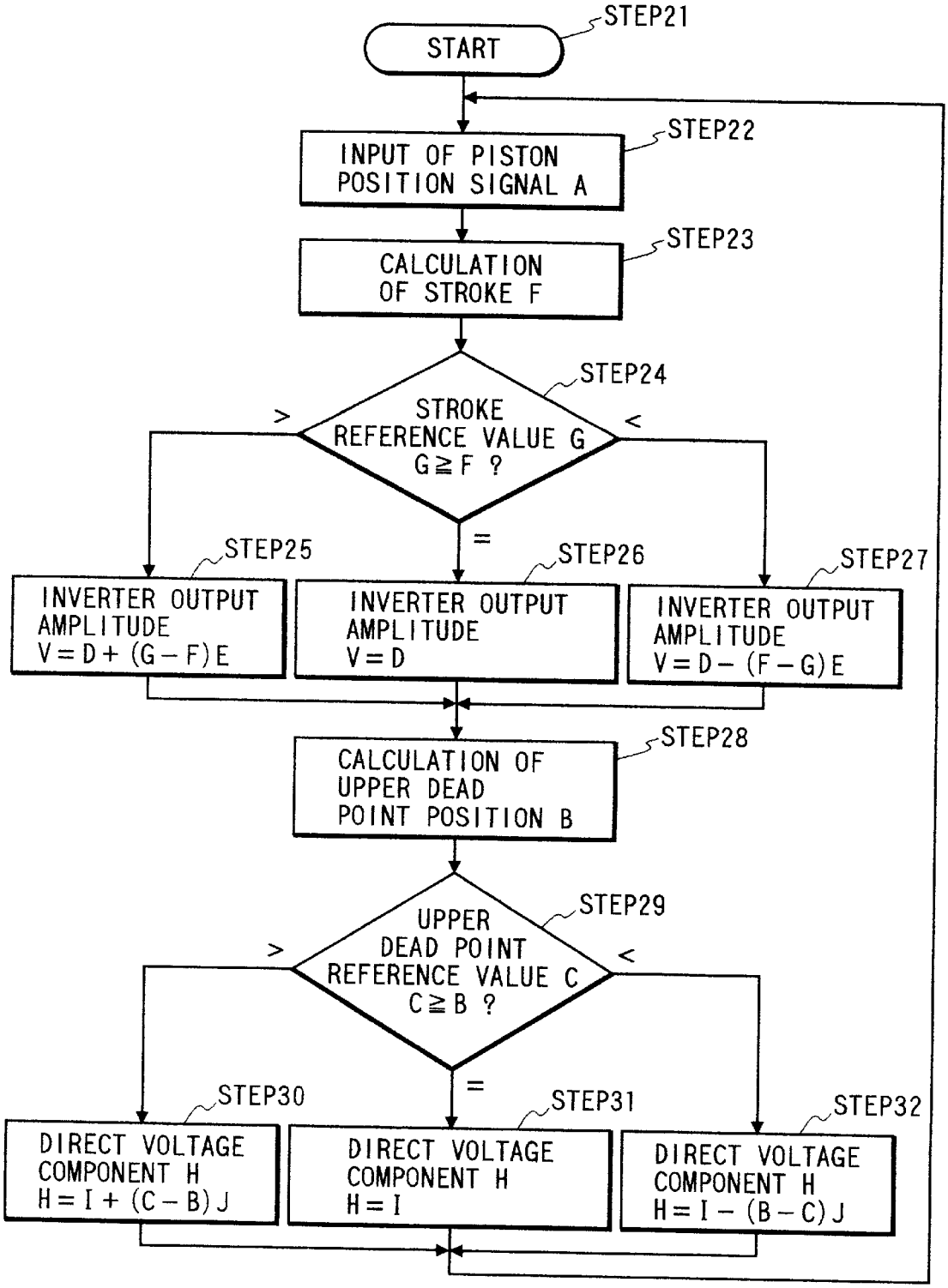
FIG. 12 is a flowchart of an operation of the fourth embodiment of the present invention.

Next, a fourth embodiment according to the present invention is described below by using attached drawings. For the same configurations as for the second embodiment, the same reference numerals are used and their detailed explanation is omitted. FIG. 11 shows an electrical circuit diagram in the fourth embodiment, FIG. 12 shows an operational flowchart in the fourth embodiment, and FIG. 10 shows an operational timing diagram in the fourth embodiment. Then, the electrical circuit in FIG. 11 is described below. An analog position signal of a piston 14 from a displacement detector 21 is converted to a digital signal via an A–D converter 27 and it is entered into a stroke calculation circuit 33 and an upper dead point position calculation means 28. An output of the stroke calculation means 33 and an output of the upper dead point position calculation means 28 are connected to an amplitude control means 30 in an inverter control means 29 and an output of the amplitude control means 30 is connected to a base drive circuit 26.

The amplitude control means 30 comprises an amplifier 35 for comparing a stroke signal from the stroke calculation circuit 33 with a stroke reference value 34 stored in a memory (now shown) in the inverter control means 29 and changing an output voltage amplitude to the base drive circuit 26 in proportion to a difference between them and an amplifier 32 for comparing an upper dead point position signal from the upper dead point position calculation circuit 28 with an upper dead point reference value 32 stored in a memory (not shown) in the inverter control means 29 and changing output voltage direct current components to the base drive circuit 26 in proportion to a difference between them.

Figure 13:
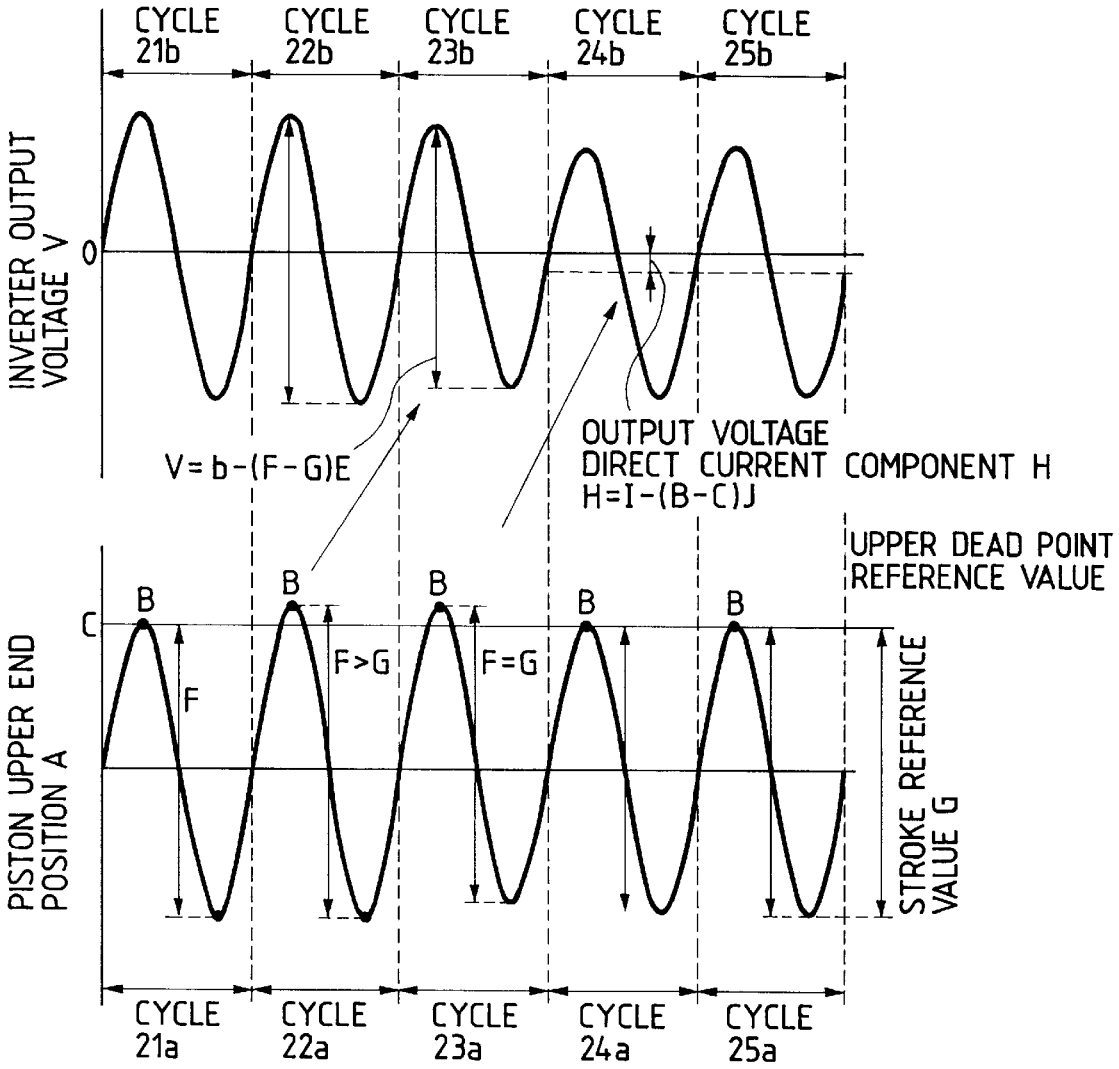
FIG. 13 is a timing diagram of an operation of the fourth embodiment of the present invention.

An operation of a vibrating compressor having the above configuration is described below based on the flowchart in FIG. 12 and the timing diagram in FIG. 13. In step 21, a commercial alternating power supply 22 is turned on. Then, an electrolytic capacitor 24 is charged via a converter circuit 23 and direct power is supplied to an inverter circuit 25. An inverter waveform is output from the base drive circuit 26 and a pair of TR1 and TR4 and a pair of TR3 and TR2 of the inverter circuit 25 repeat setting or resetting of the ON or OFF state alternately.

Then, after power converted from a direct current to an alternating current is supplied from the inverter circuit 25 to a coil 13 of the vibrating compressor 10, the vibrating compressor 10 starts running and the piston 14 connected to the coil 13 vibrates in an axial direction of the cylinder 11 according to a frequency of the supplied alternating current to compress refrigerant in the pressing chamber 17. In step 22, an analog position signal of the piston 14 from the displacement detector 21 is converted to a digital signal via the A–D converter 27 and it is entered into the stroke calculation circuit 33. This signal indicates an upper end position of the piston 14 facing the pressing chamber 17 and it is considered as A. Immediately after the power supply is turned on, A is set to 0.

Next, in step 23, a stroke F of the piston 14 is calculated based on the maximum value and the minimum value of the upper end position of the piston 14 as shown in a cycle 21*a* in FIG. 10 in the stroke calculation circuit 33. In step 24, a stroke F is compared with a preset stroke reference value G in an amplitude control means 30 in the inverter control means 29. If the stroke reference value G is greater than the stroke F, processing proceeds to step 25 and an inverter output voltage amplitude D is increased to a level which is the current output voltage D plus (G–F) times a unit voltage E according to a difference between the stroke reference value G and the stroke F. If the stroke reference value G is the same as the stroke F, processing proceeds to step 26 and the inverter output voltage V keeps the current output voltage D. If the stroke reference value G is smaller than the stroke F, processing proceeds to step 27 and the inverter output voltage amplitude is decreased to a level which is the current output voltage D minus (F–G) times the unit voltage E according to a difference between the stroke F and the stroke reference value G.

If an external condition is changed, for example, if an external temperature is rapidly decreased, a pressure in the pressing chamber 17 is decreased, and the piston stroke F is extended due to a stronger resonance spring 20 in a viewpoint of a balance between a gas spring in the pressing chamber 17 and the resonance spring 20. In other words, when the stroke F becomes greater than the stroke reference value G, it is also possible that the upper dead point position B exceeds the upper dead point reference value C. Then, processing proceeds from the step 24 to the step 27 to decrease the inverter output voltage amplitude V to a level which is the current output voltage amplitude V minus (F–G) times the unit voltage E as shown in cycle 23*b* according to a difference between the stroke F and the stroke reference value G. Therefore, although the piston 14 operates with a stroke equal to the stroke reference value, the upper dead point position B continues to be greater than the upper dead point reference value C as shown in the cycle 23*a*.

Accordingly, in step 28, the upper dead point position B which is the maximum value of the upper end position of the piston 14 is calculated as shown in the cycle 23a in the upper dead point position calculation means 28. In step 29, the upper dead point position B is compared with the preset upper dead point reference value C in the amplitude control means 30 in the inverter control means 29 and it is found that the upper dead point position B is greater than the upper dead point reference value C as shown in the cycle 23*a*, and therefore, processing proceeds to step 32. As shown in a cycle 24*b*, a direct current component voltage H of the inverter output voltage is decreased to the current voltage value H minus (B–C) times a unit voltage J according to a difference between the upper dead point position B and the upper dead point reference value C.

Again, the piston 14 continues a stable operation in which the stroke F matches the stroke reference value G and the upper dead point position B is equal to the upper dead point reference value C as shown in a cycle 25*a*.

As described above, the vibrating compressor of this embodiment comprises the upper dead point position calculation means 29 for calculating an upper dead point position of the piston based on a piston position signal from. the displacement detector 21, the stroke calculation means 33 for calculating a stroke of the piston based on a piston position signal, and the inverter control means 30 for changing an output voltage amplitude of the inverter circuit 25 according to a difference between the stroke F and the preset stroke reference value G and for changing a direct current voltage component of the inverter circuit 25 according to a difference between the upper dead point position and the preset upper dead point reference value, therefore, it does not cause any changes of its refrigerating capability by always keeping the stroke of the piston 14 to a certain level with changing an output voltage amplitude of the inverter circuit 25 according to a difference between the stroke and the stroke reference value even if an external condition changes.

In addition, the vibrating compressor does not cause any over strokes of the piston 14 by always keeping an upper dead point of the piston 14 to a reference position with changing the direct voltage component of the inverter circuit 25 according to a difference between the upper dead point position and the upper dead point reference value. Therefore, the intake valve 15 nor an ejector valve 16 in the cylinder 11 is not damaged by the piston 14 striking the top of the cylinder 11.

(Fifth embodiment)

Figure 14:
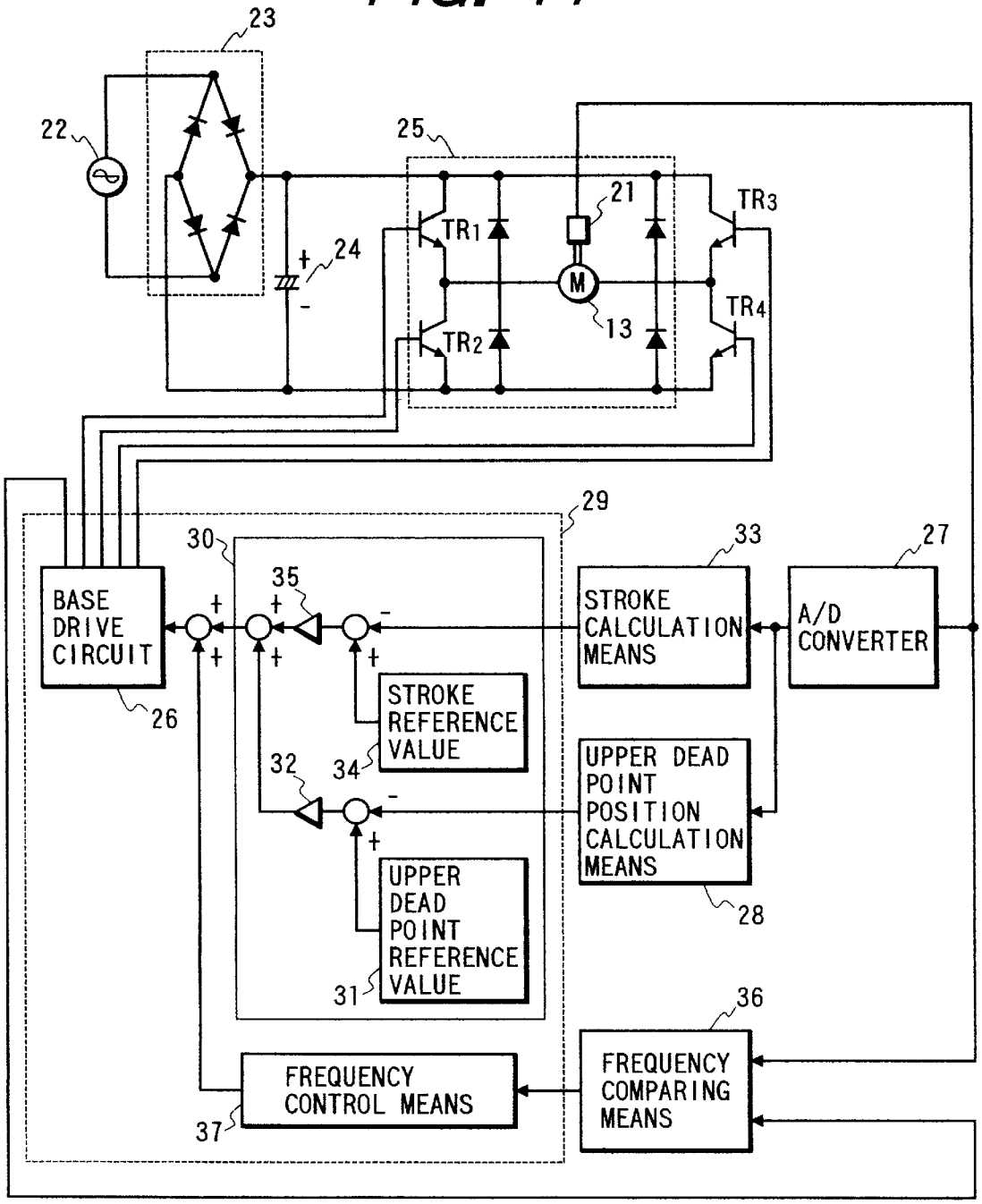
FIG. 14 is an electrical circuit diagram of a fifth embodiment of the present invention.
Figure 15:
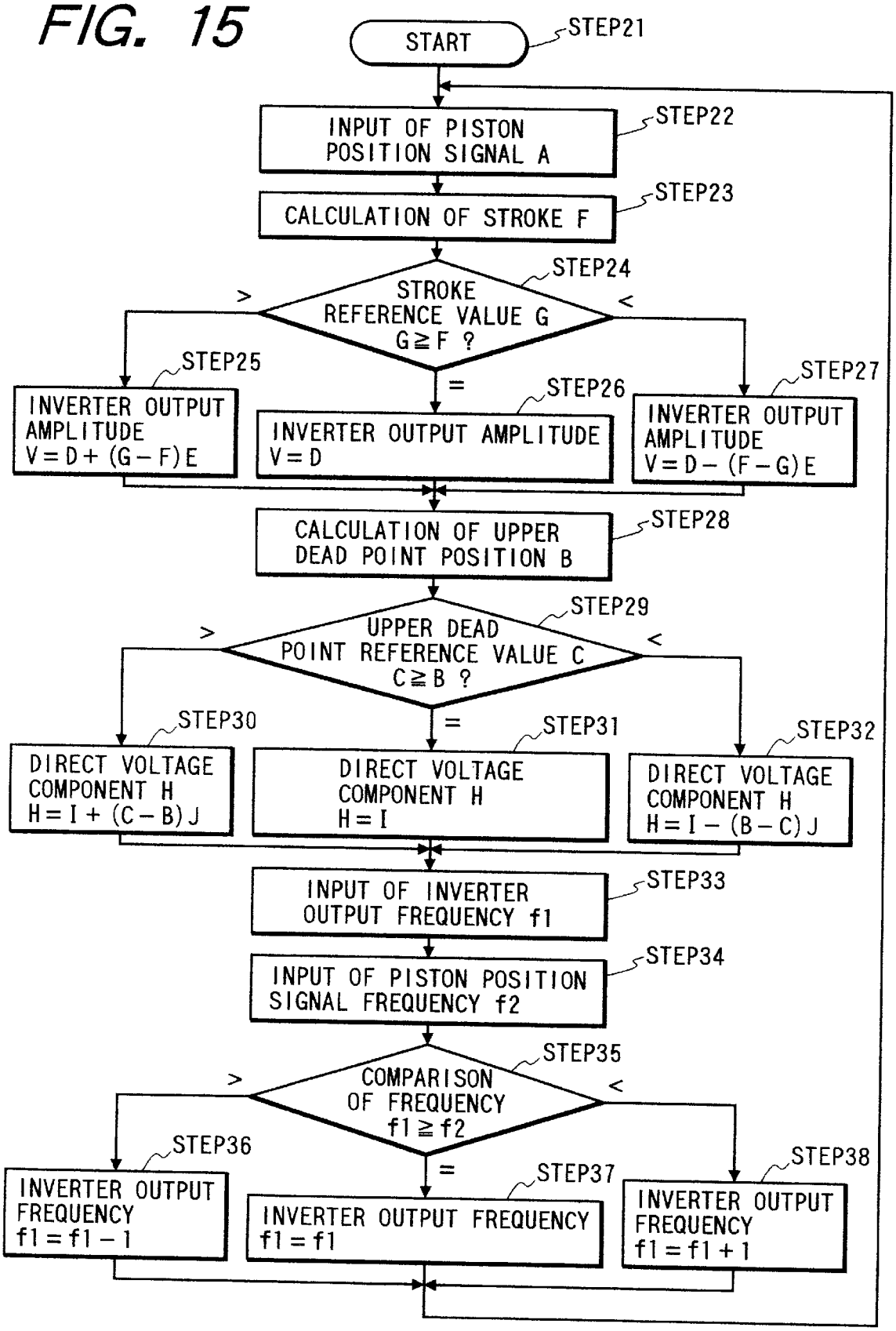
FIG. 15 is a flowchart of an operation of the fifth embodiment of the present invention.
Figure 16:
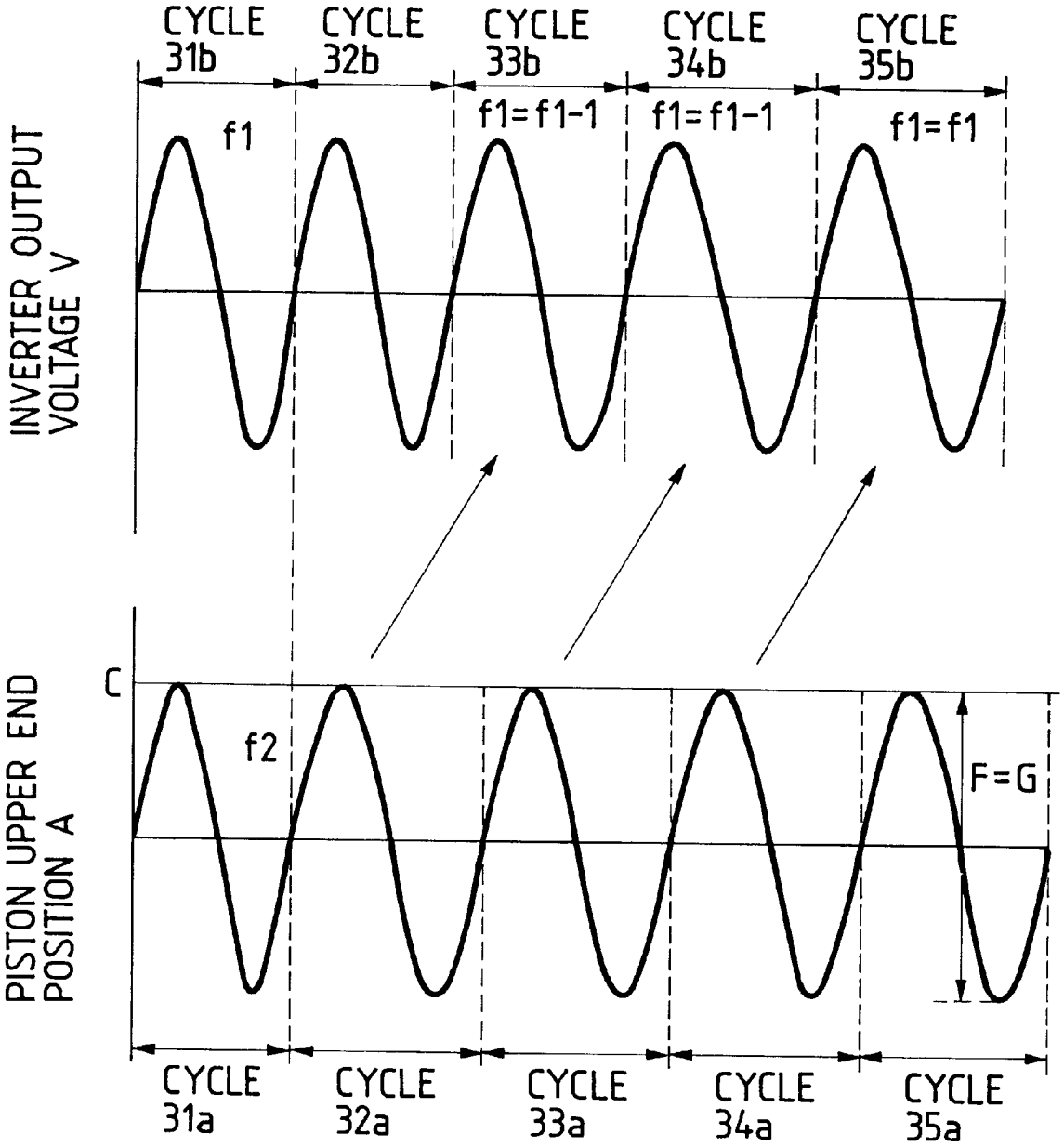
FIG. 16 is a timing diagram of an operation of the fifth embodiment of the present invention.

Next, a fifth embodiment according to the present invention is described below by using attached drawings. For the same configurations as for the second embodiment, the same reference numerals are used and their detailed explanation is omitted. FIG. 14 shows an electrical circuit diagram in the fifth embodiment, FIG. 15 shows an operational flowchart in the fifth embodiment, and FIG. 16 shows an operational timing diagram in the fifth embodiment. Then, the electrical circuit in FIG. 14 is described below. An analog position signal of a piston 14 from a displacement detector 21 is converted to a digital signal via an A–D converter 27 and it is entered into a stroke calculation circuit 33 and an upper dead point position calculation means 28. An output of the stroke calculation means 33 and an output of the upper dead point position calculation means 28 are connected to an amplitude control means 30 in an inverter control means 29 and an output of the amplitude control means 30 is connected to a base drive circuit 26.

The amplitude control means 30 comprises an amplifier 35 for comparing a stroke signal from the stroke calculation circuit 33 with a stroke reference value 34 stored in a memory (now shown) in the inverter control means 29 and changing an output voltage amplitude to the base drive circuit 26 in proportion to a difference between them and an amplifier 32 for comparing an upper dead point position signal from the upper dead point position calculation means 28 with an upper dead point reference value 32 stored in a memory (not shown) in the inverter control means 29 and changing output voltage direct current components to the base drive circuit 26 in proportion to a difference between them.

In addition, an output frequency f1 of the inverter circuit 25 from the base drive circuit 26 and an operational frequency signal f2 of the piston 14 from the displacement detector 21 are entered into a frequency comparator circuit 36. An output of the frequency comparator circuit 36 is entered into a frequency control circuit 37 in the inverter control means 29 and an output of the frequency control circuit 37 is connected to the base drive circuit 26.

An operation of a vibrating compressor 10 having the above configuration is described below based on the flowchart in FIG. 15 and the timing diagram in FIG. 16. In the flowchart in FIG. 15, operations from step 21 to step 32 are the same as for those in the fourth embodiment. In other words, in step 21, a commercial alternating power supply 22 is turned on. Then, an electrolytic capacitor 24 is charged via a converter circuit 23 and direct power is supplied to the inverter circuit 25. An inverter waveform is output from the base drive circuit 26 and a pair of TR1 and TR4 and a pair of TR3 and TR2 of the inverter circuit 25 repeat setting or resetting of the ON or OFF state alternately.

Then, after power converted from a direct current to an alternating current is supplied from the inverter circuit 25 to a coil 13 of the vibrating compressor 10, the vibrating compressor 10 starts running and the piston 14 connected to the coil 13 vibrates in an axial direction of the cylinder 11 according to a frequency of the supplied alternating current to compress refrigerant in the pressing chamber 17.

If an external condition is changed, for example, if an external temperature is rapidly decreased, a pressure in the pressing chamber 17 is decreased, and the piston stroke F is extended due to a stronger resonance spring 20 in a viewpoint of a balance between a gas spring in the pressing chamber 17 and the resonance spring 20. In other words, when the stroke F becomes greater than the stroke reference value G, it is also possible that the upper dead point position B exceeds the upper dead point reference value C as shown in a cycle 22*a* in FIG. 13. Then, by means of the operations from the steps 21 to 32, the piston 14 continues stable operations in which the stroke F is equal to the stroke reference value G and the upper dead point position B is equal to the upper dead point reference value C as shown in a cycle 25.

If an external condition changes, however, for example, if an external air temperature is rapidly decreased, a difference may be generated between an output frequency of the inverter circuit 25, that is, a frequency of an electrical system and a frequency of a position signal of the piston 14, that is, a resonance frequency of a mechanical system formed by the refrigerant gas and the resonance spring 20 since the piston stroke F becomes greater than the stroke reference value G and the upper dead point position B also exceeds the upper dead point reference value C. In step 33, an inverter output frequency signal from the base drive circuit 26 is entered into the frequency comparator circuit 36, and in step 34, a frequency signal of an analog position signal of the piston 14 from the displacement detector 21 is entered into the frequency comparator circuit 36.

Next, in step 35, an output frequency of the inverter circuit 25, that is, a frequency f1 of the electrical system is compared with a frequency of a position signal of the piston 14, that is, a resonance frequency f2 of the mechanical system formed by the refrigerant gas and the resonance spring 20 in the frequency comparator circuit 36. Then, if the frequency f1 of the electrical system is greater than the resonance frequency f2 of the mechanical system, processing proceeds to step 36 to decrease the output frequency of the inverter circuit 25, that is, the frequency f1 of the electrical system by 1 Hz.

If the frequency f1 of the electrical system is the same as the resonance frequency f2 of the mechanical system, processing proceeds to step 37 and the output frequency of the inverter circuit 25, that is, the frequency f1 of the electrical system keeps the current frequency f1.

If the frequency f1 of the electrical system is greater than the resonance frequency f2 of the mechanical system, processing proceeds to step 38 to increase the output frequency of the inverter circuit 25, that is, the frequency f1 of the electrical system by 1 Hz. In step 35, the output frequency f1 of the inverter circuit 25 is compared with the frequency f2 of the position signal of the piston 14 in the frequency comparing means 36. Then, if the output frequency f1 of the inverter circuit 25 is greater than the frequency f2 of the position signal of the piston 14 as shown in cycles 32*a* and 32*b* in FIG. 16, processing proceeds to step 36 to decrease the output frequency of the inverter circuit 25, that is, the frequency f1 of the electrical system by 1 Hz.

After that, in the step 33 in the next cycle, an inverter output frequency signal is entered into the frequency comparator circuit 36 again, and in step 34, a frequency signal of an analog position signal of the piston 14 is entered into the frequency comparing means 36. In step 35, the output frequency f1 of the inverter circuit 25 is compared with the frequency f2 of the position signal of the piston 14. Then, if the frequency f1 of the position signal of the piston 14 is still greater than the frequency f2 of the position signal of the piston 14 as shown in cycles 3*a* and 3*b* in FIG. 16, processing proceeds to the step 36 again to decrease the output frequency of the inverter circuit 25, that is, the frequency f1 of the electrical system by 1 Hz further.

If the frequency f1 of the position signal of the piston 14 is equal to the frequency of the position signal of the piston 14 as shown in cycles 34*a* and 34*b*, processing proceeds to step 37 to keep the output frequency f1 of the inverter circuit 25 at the same frequency.

Again, the piston 14 can run very efficiently by fully utilizing resonance characteristics of the spring system since the stroke F is equal to the stroke reference value G as shown in a cycle 35*a*, the upper dead point position B is equal to the upper dead point reference value C, and the output frequency of the inverter circuit 25, that is, the frequency f1 of the electrical system is equal to the frequency of the position signal of the piston 14, that is, the resonance frequency f2 of the mechanical system formed by the refrigerant gas and the resonance spring 20.

As described above, the vibrating compressor of this embodiment comprises the upper dead point position calculation means 29 for calculating an upper dead point position of the piston based on a piston position signal from the displacement detector 21, the stroke calculation means 33 for calculating a stroke of the piston based on the piston position signal, the frequency comparator circuit 36 for detecting a difference between an output frequency of the inverter circuit 25 and a frequency of the piston position signal, and the inverter control means 30 for changing an output voltage amplitude of the inverter circuit 25 according to a difference between the stroke F and the preset stroke reference value G and for dissolving a difference between the output frequency of the inverter circuit and the frequency of the piston position signal by changing an output voltage direct current component of the inverter circuit 25 according to a difference between the upper dead point position and the preset upper dead point reference value and also changing the output frequency of the inverter circuit, therefore, it does not cause any changes of its refrigerating capability by always keeping the stroke of the piston 14 to a certain level with changing an output voltage amplitude of the inverter circuit 25 according to a difference between the stroke and the stroke reference value even if an external condition changes.

In addition, the vibrating compressor does not cause any over strokes of the piston 14 by always keeping an upper dead point of the piston 14 to a reference position with changing the direct voltage component of the inverter circuit 25 according to a difference between the upper dead point position and the upper dead point reference value. Therefore, the intake valve 15 nor the ejector valve 16 in the cylinder 11 is not damaged by the piston 14 striking the top of the cylinder 11. Furthermore, the output frequency of the inverter circuit 25, that is, the frequency f1 of the electrical system is equal to the frequency of a position signal of the piston 14, that is, the resonance frequency f2 of the mechanical system formed by the refrigerant gas and the resonance spring 20, therefore, the vibrating compressor can run very efficiently by fully utilizing resonance characteristics of the spring system.

(Sixth embodiment)

Figure 17:
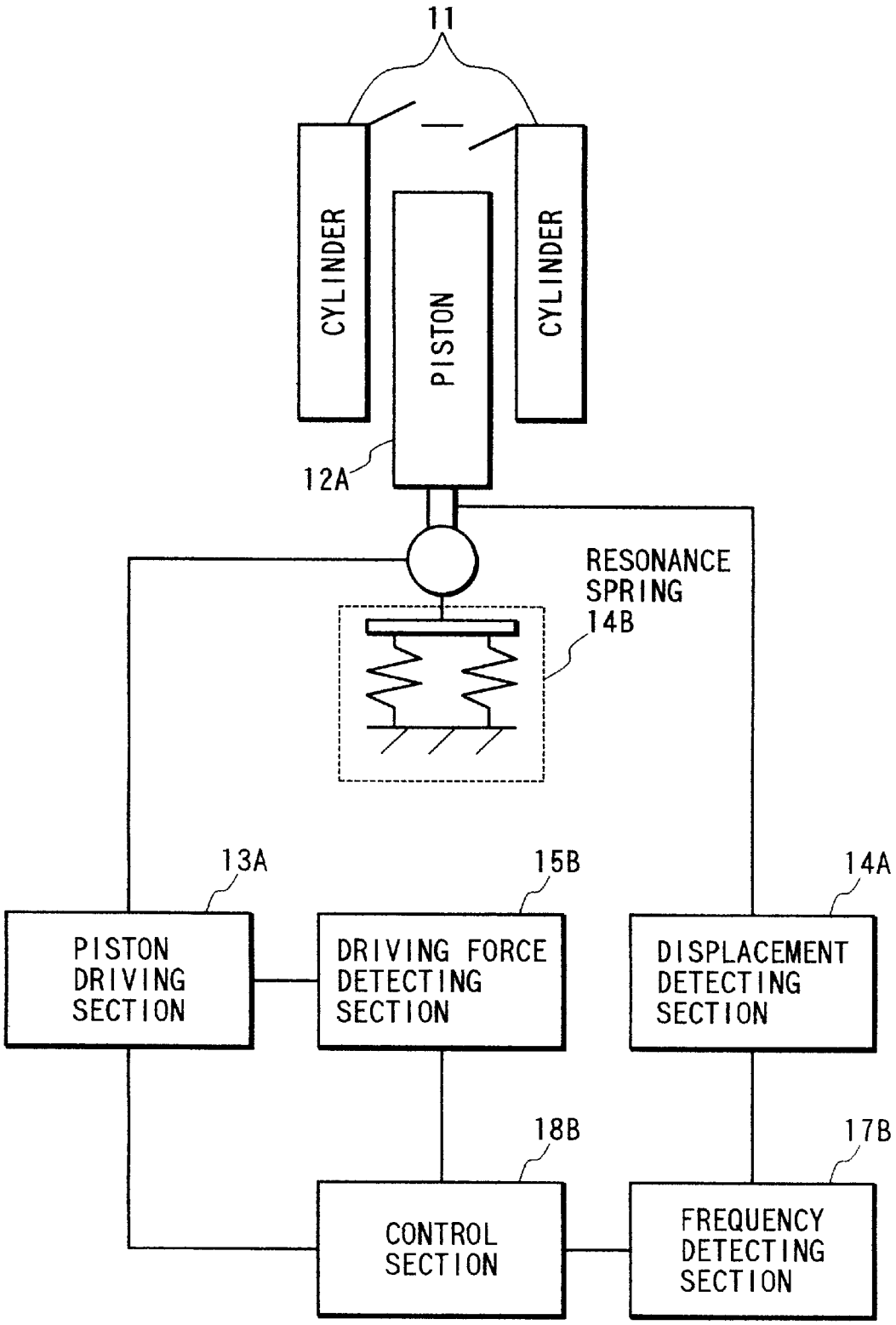
FIG. 17 is a configuration diagram of a vibrating compressor of a sixth embodiment of the present invention.
Figure 18:
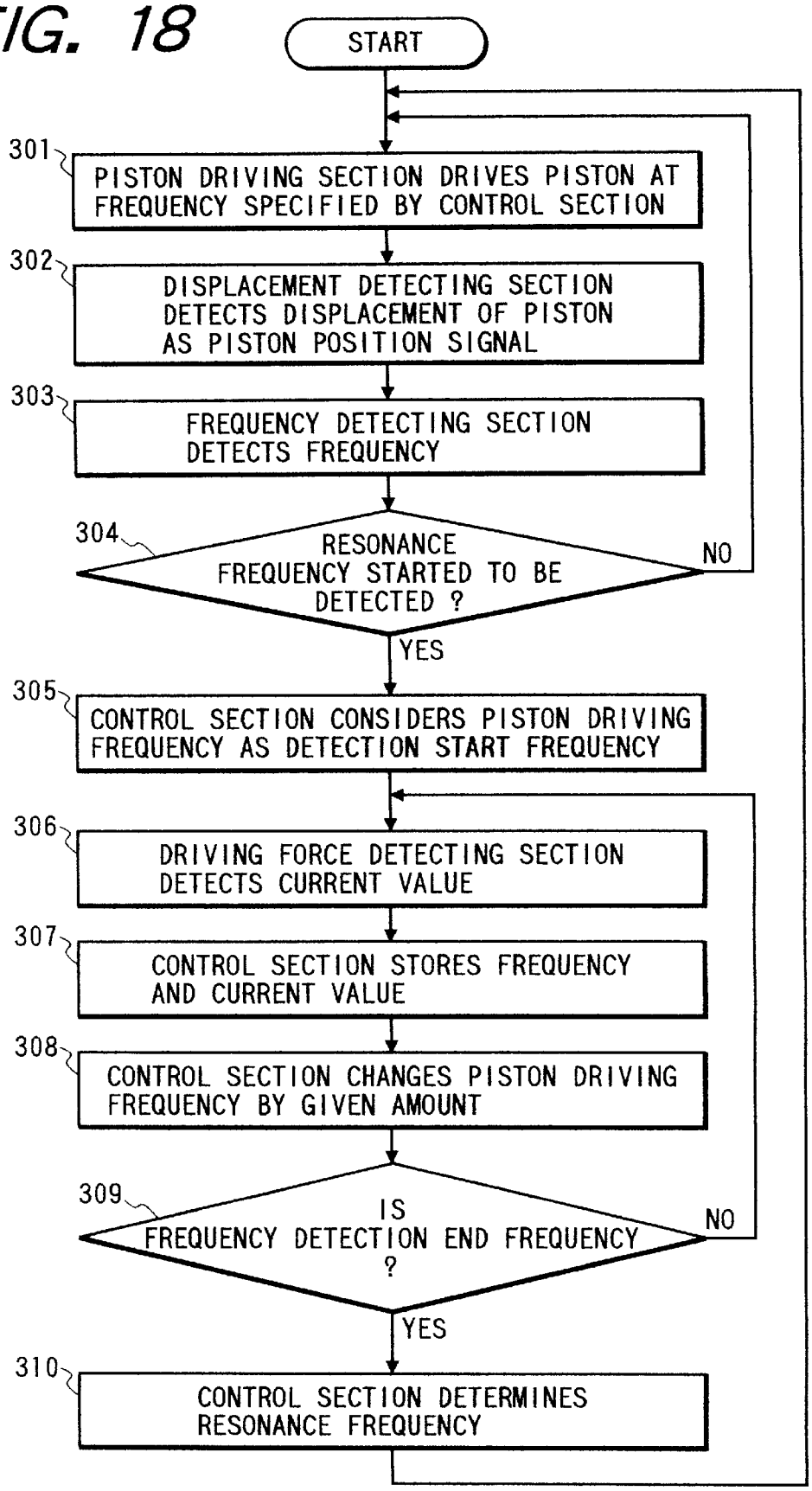
FIG. 18 is a flowchart illustrating an operation of the sixth embodiment.
Figure 19:
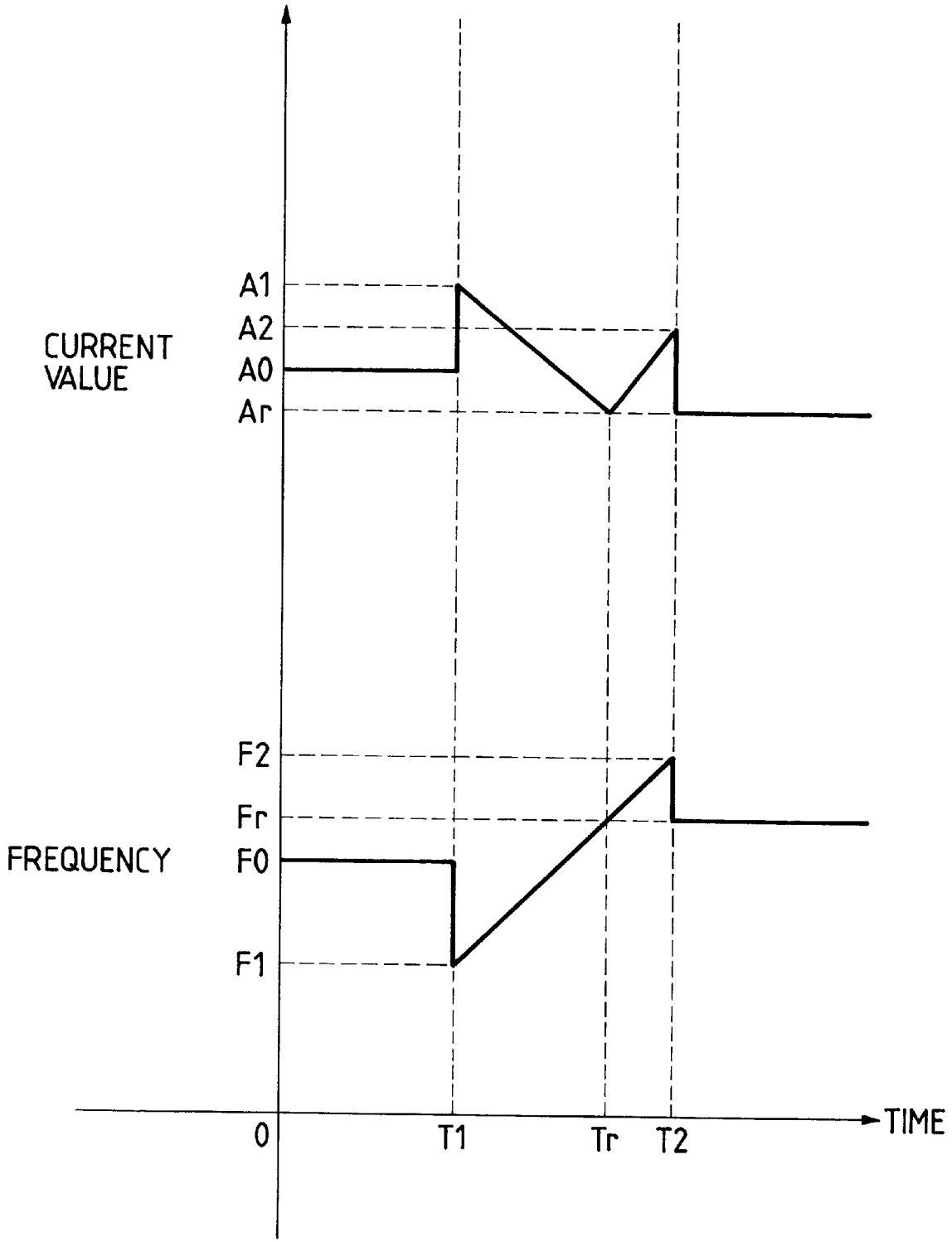
FIG. 19 is a timing chart illustrating an operation of the sixth embodiment of the present invention.

FIG. 17 shows a configuration diagram of a vibrating compressor of a sixth embodiment according to the present invention. FIG. 18 is a flowchart illustrating an operation of the embodiment, FIG. 19 is a timing diagram of the embodiment, and FIG. 20 is a stored state diagram indicating a state when a control section of the sixth embodiment keeps frequencies and current values of a piston driving force of an alternating voltage. Referring to FIG. 17, there are shown a cylinder 11, a piston 12A, a piston driving section 13A, a resonance spring 14B, a driving force detecting section 15B, a displacement detecting section 14A, a frequency detecting section 17B, and a control section 18B. In these drawings, the piston 12A moves axially in the cylinder 11 by means of a driving force from the piston driving section 13A.

The driving force detecting section 15B detects a current value of an alternating voltage applied to the piston 12A as a piston driving force by the piston driving section 13A. The displacement detecting section 14A, which comprises a differential transformer, is connected in an axial direction of the piston 12A and it detects a displacement of the piston 12A as a piston position signal such as an output voltage value of the differential transformer.

The frequency detecting section 17B detects a frequency at which the piston 12A makes a reciprocating motion based on a position signal of the piston 12A detected by the displacement detecting section 14A. As for a detecting method of the frequency in this detection, the frequency can be detected based on a period of time from a time when the piston 12A passes an upper dead point position, that is, a point where the piston 12A gets closest to a valve installed in the cylinder 11 to a time when it passes the upper dead point position next, or the frequency can be detected based on a period of time from a time when the piston 12A passes a lower dead point position, that is, a point where the piston 12A gets farthest from the valve installed in the cylinder 11 to a time when it passes the lower dead point position next, or the frequency can be detected based on a period of time from a time when the piston 12A passes a center of an amplitude to a time when it passes the center of the amplitude next.

The control section 18B changes stepwise a frequency of an alternating voltage applied to the piston 12A every certain period of time as a piston driving force by the piston driving section 13A from a certain value to another certain value at given intervals, stores a current value detected by the current driving force detecting section 15B, determines a frequency at which the minimum current value is indicated as a resonance frequency of the piston 12A and the resonance spring 14B, and defines it as a frequency of an alternating voltage applied to the piston 12A by the piston driving section 13A as a piston driving force. FIG. 19 shows a state of changes of current values detected when the frequency changes stepwise from F1 to F2 in a time period from time T1 to time T2, where Ar indicates the minimum current value at time Tr at frequency Fr.

In addition, FIG. 20 shows a state of a frequency and current values stored in the control section 18B. In this example, it indicates that the frequency is changed by 0.1 Hz from 50.0 Hz and the control section stores n current values in total, in which the first current value is 0.57 A, the second current value is 0.54 A,—, and the nth current value is 0.46 A and the ith current value is the minimum. Accordingly, the ith frequency, that is, a resonance frequency can be obtained by an expression, 50.0+0.1*(i-1).

A concrete example of an operation of the vibrating compressor of the sixth embodiment having the above configuration is described below by using the flowchart in FIG. 18 and the timing diagram in FIG. 19. The piston driving section 13A drives the piston 12A at a frequency given by the control section 18B (step 301). The displacement detecting section 14A detects a displacement of the piston 12A as a piston position sign al (step 302).

The frequency detecting section 17B detects a frequency based on a piston position signal from the displacement detecting section 14A (step 303). The control section 18B determines whether or not a resonance frequency is started to be detected. If it determines that the detection is not started, the control returns to the step 301. If it determines that the detection is started (T1 in FIG. 19), processing in step 305 is executed (step 304). The control section 18B sets a piston driving frequency to a detection start frequency (step 305, F in FIG. 19). The driving force detecting section 15B detects a current value of a piston driving force supplied to the piston 12A by the piston driving section 13A (step 306). The control section 18B stores a frequency detected by the frequency detecting section 17B and a current value detected by the driving force detecting section 15B (step 307, FIG. 20). The control section 18B changes the piston driving frequency by a given amount (step 308). The control section 18B determines whether or not the frequency is a detection end frequency. If it is not the detection end frequency, processing in steps 306 to 308 is executed. If it is the detection end frequency (F2 in FIG. 19), processing in step 310 is executed (step 309).

The control section 18B detects a current value indicating the minimum value in the current values stored in the step 307 (Ar in FIG. 19), determines the frequency at the detection (Fr in FIG. 19) as a resonance frequency, and then the control returns to step 301 (step 310). As for a determination of whether or not the control section 18B starts to detect a resonance frequency in step 304, it should be determined by whether or not a certain time has been passed, for example, by using a timer. In addition, as for amounts of change of a detection start frequency in step 305, a detection end frequency in step 309, and a frequency in step 308, a previously determined amount can be used such as, for example, an amount changed by 0.1 Hz for a range from 50.0 Hz to 55.0 Hz or an amount changed by −1 Hz for a range from 65 Hz to 40 Hz, a predetermined value can be set by using the current driving frequency as a reference such as, for example, an amount changed by 0.2 Hz for a range of the current operation frequency {SYMBOL 177}3.0 Hz, an amount can be set by using an input device on each occasion, or a combination of these methods can be used.

As described above, the vibrating compressor of the sixth embodiment comprises the piston driving section 13A for giving a piston driving force to the piston 12A, the driving force detecting section 15B for detecting a current value of a piston driving force given to the piston 12A by the piston driving section 13A, the displacement detecting section 14A connected in an axial direction of the piston 12A, the frequency detecting section 17B for detecting a frequency based on a piston position signal from the displacement detecting section 14A, and the control section for changing stepwise a frequency of a piston driving force given to the piston 12A by the piston driving section 13A every certain period of time, within a certain range, and by certain amounts, determining a frequency detected by the frequency detecting section 17B when the current value detected by the driving force detecting section 15B becomes the minimum as a resonance frequency of the piston 12A and the resonance spring 14B, and considering it as a frequency of a piston driving force supplied to the piston 12A by the piston driving section 13A, therefore, it can run without reducing an efficiency of the compression since the control section 18B detects the resonance frequency and changes the frequency of the piston driving force supplied to the piston 12A by the piston driving section 13A to the resonance frequency even if there is a difference between the driving frequency and the resonance frequency of the piston 12A and the resonance spring 14B at a change of an external condition such as a temperature condition or a pressure condition.

(Seventh embodiment)

Figure 21:
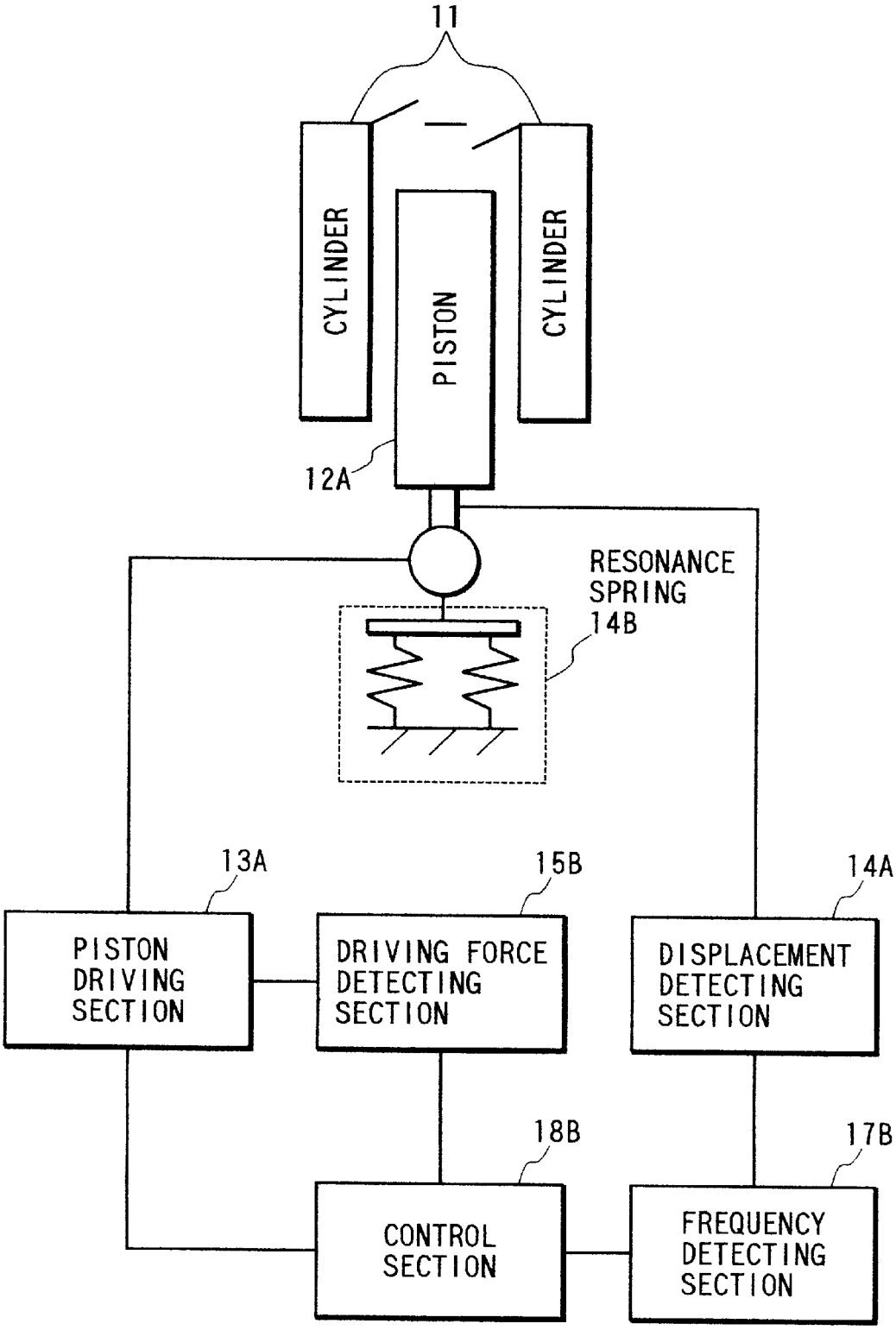
FIG. 21 is a configuration diagram of a vibrating compressor of a seventh embodiment of the present invention.
Figure 22:
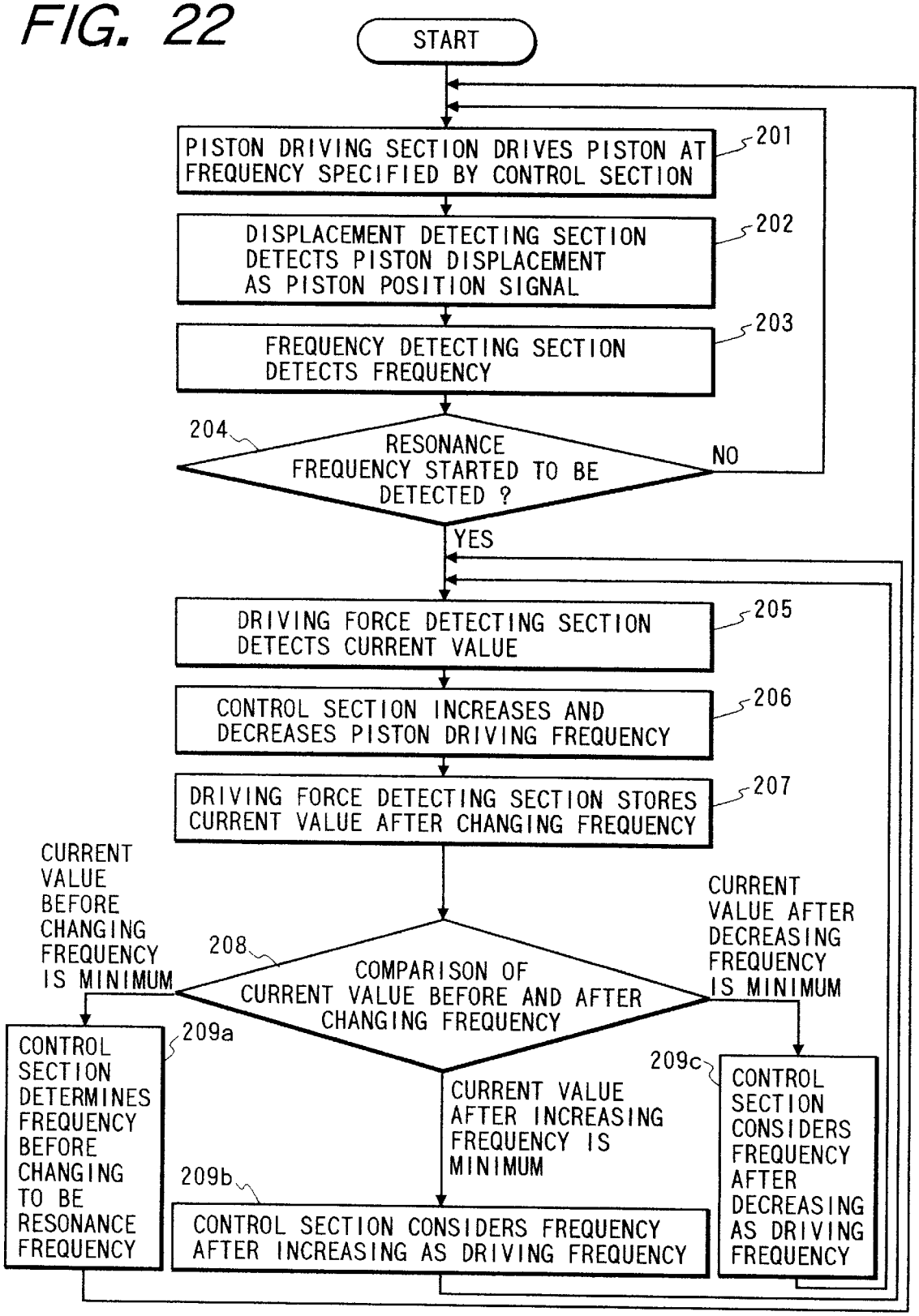
FIG. 22 is a flowchart illustrating an operation of the seventh embodiment of the present invention.

Next, a seventh embodiment of the present invention is described below by using attached drawings. For the same configuration as for the sixth embodiment, the same reference numerals are used and their detailed explanation is omitted. FIG. 21 illustrates a configuration diagram of a vibrating compressor of the seventh embodiment according to the present invention. FIG. 22 shows a flowchart of operations of the seventh embodiment and FIG. 23 shows a state in which a control section of the seventh embodiment compares current values detected by a driving force detecting section.

Referring to FIG. 21, there is shown a control section 18C, which increases or decreases a frequency of an alternating voltage supplied to a piston 12A as a piston driving force every certain period of time by a certain amount by a piston driving section 13A, and if a current value detected by the driving force detecting section 15B after the increase or decrease of the frequency is smaller than that before the increase or decrease, controls the piston driving section 13A to drive the piston 12A at a frequency used when a current value is smaller, and determines a resonance frequency of the piston 12A and a resonance spring 14B by repeating the increase and decrease of the frequency until the current value after an increase or decrease becomes greater than that before an increase or decrease of the frequency in both cases of an increase and decrease of the frequency to consider the resonance frequency as a frequency of a piston driving force supplied to the piston 12A by the piston driving section 13A.

Figure 23:
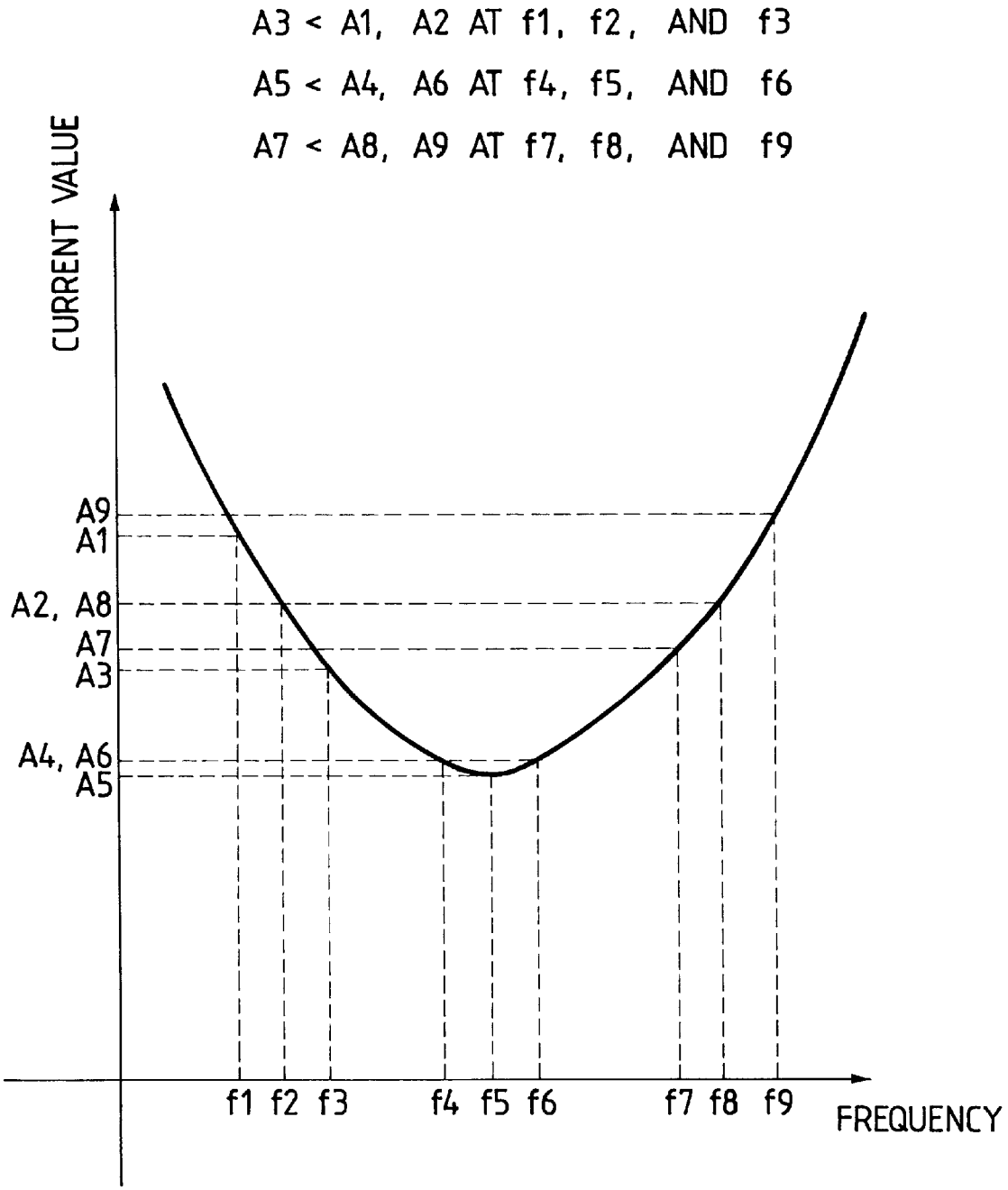
FIG. 23 is a characteristic diagram illustrating a state of comparing current values in a control section of the seventh embodiment.
Figure 24:
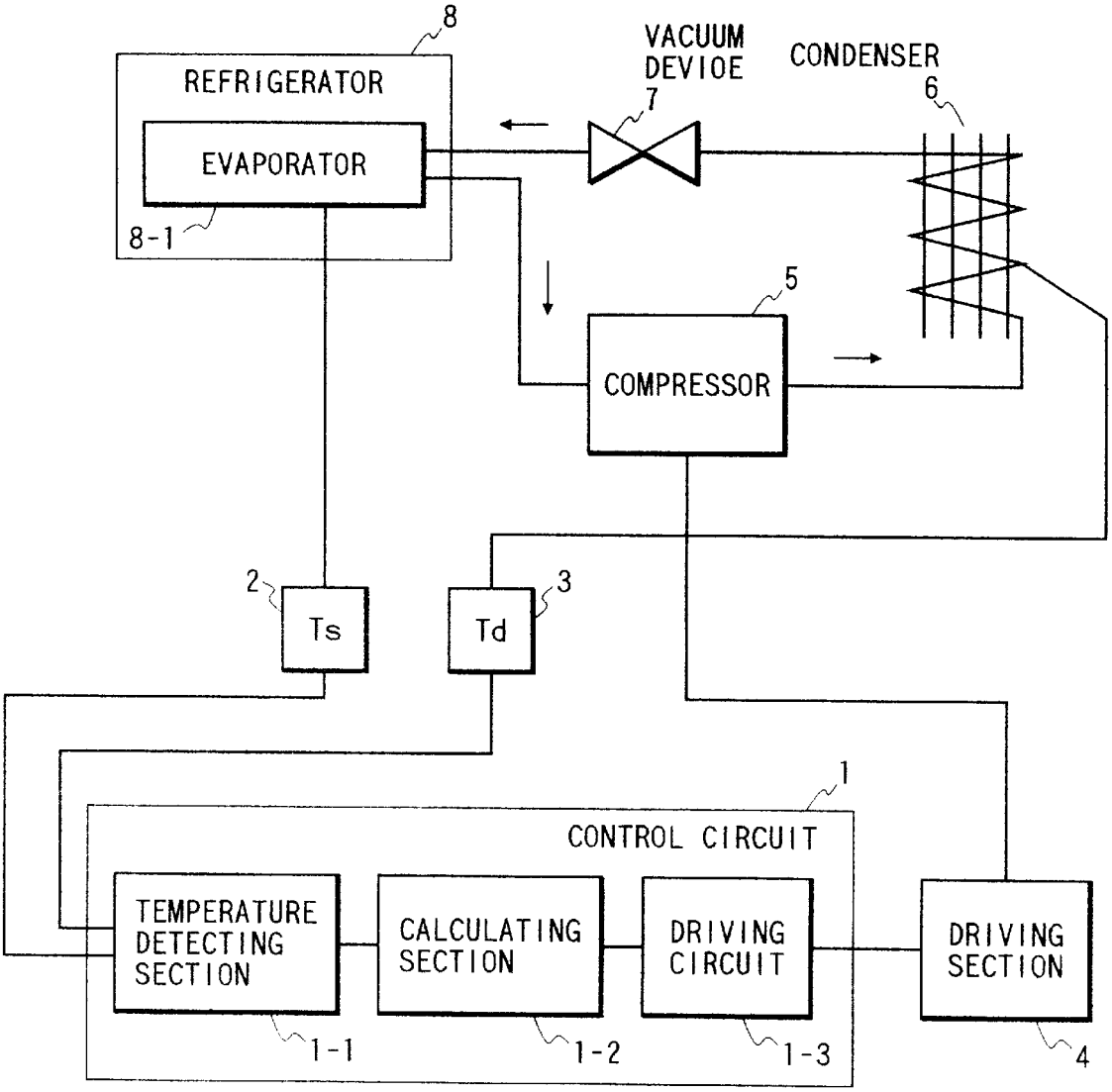
FIG. 24 PRIOR ART
FIG. 24 is a configuration diagram illustrating an example of a conventional vibrating compressor.
Figure 25:
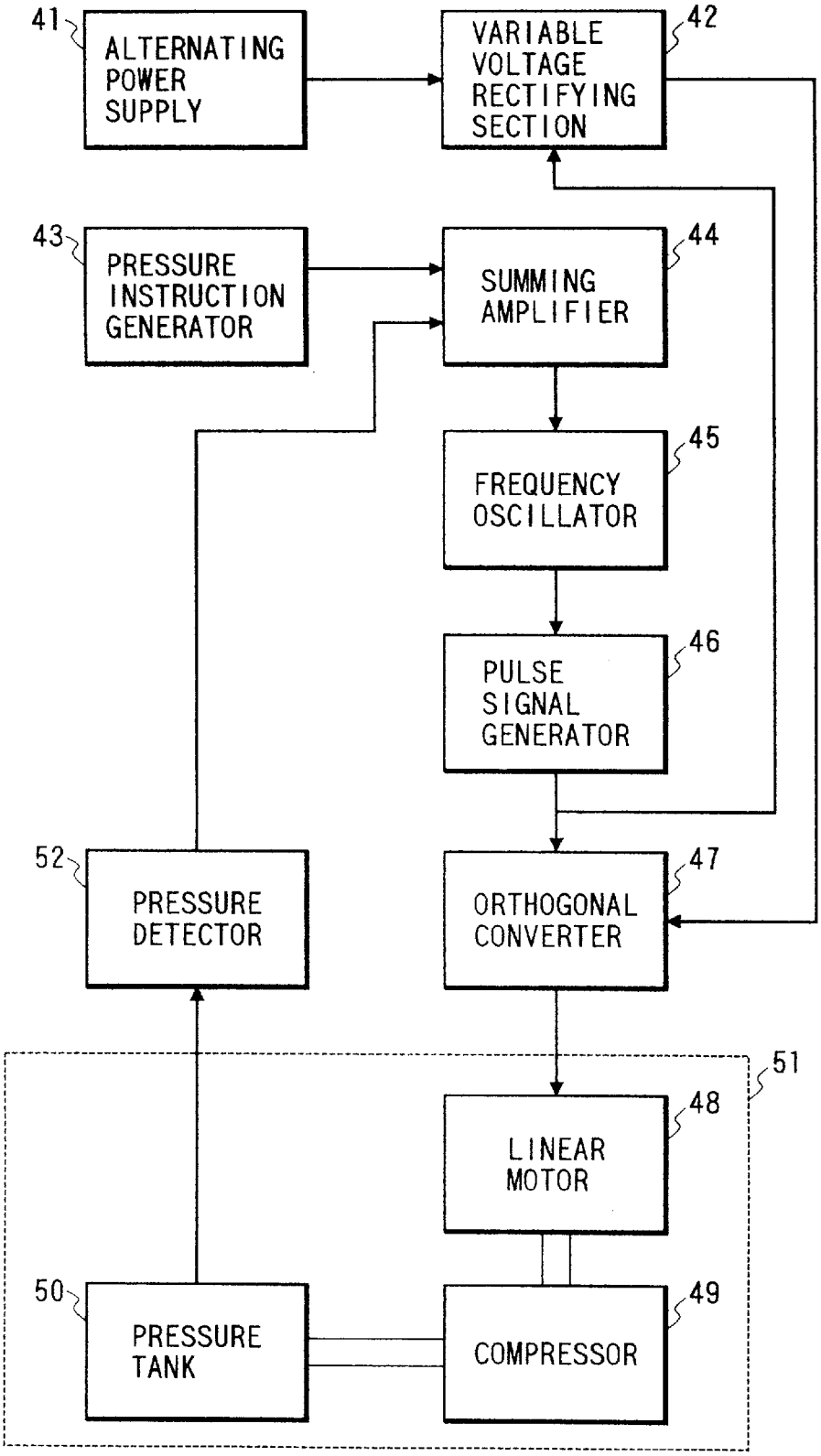
FIG. 25 PRIOR ART
FIG. 25 is a configuration diagram illustrating another example of a conventional vibrating compressor.

Referring to FIG. 23, f2, f5, and f8 indicate frequencies before the control section 18C in the seventh embodiment of this invention increases or decreases the frequencies, f1, f4, and f7 indicate frequencies obtained after the control section 18C decreases the frequencies f2, f5, and f8, and f3, f6, and f9 indicate frequencies obtained after the control section 18C increases the frequencies f2, f5, and f8, respectively. In addition, A1, A2,—, and A9 indicate current values detected by the driving force detecting section 15B at frequencies f1, f2,—, and f9, respectively. The control section 18C compares, for example, A1, A2, and A3 each other at f1, f2, and f3 and considers f3 as a frequency at which the piston driving section 13A newly applies a driving force to the piston 12A since A3 is smaller than A1 and A2 (A3<A1, A2). In the same manner, the control section 18C compares, for example, A7, A8, and Ag each other at frequencies f7, f8, and f9 and considers f7 as a frequency at which the piston driving section 13A newly applies a driving force to the piston 12A since A7 is smaller than A8 and A9 (A7<A8, A9). In the same manner, the control section 18C, for example, compares A4, A5, and A6 each other at frequencies f4, f5, and f6 and determines f5 as a resonance frequency since A5 is smaller than A4 and A6 (A5<A4, A6), and then considers it as a frequency at which the piston driving section 13A applies a driving force to the piston 12A.

An example of an operation of the vibrating compressor of the seventh embodiment having the above configuration is described below by using a flowchart in FIG. 22. The piston driving section 13A drives the piston 12 at a frequency given by the control section 18C (step 201). A displacement detecting section 14A detects a displacement of the piston as a piston position signal (step 202). A frequency detecting section 17B detects a frequency based on the piston position signal from the displacement detecting section 14A (step 203). The control section 18C determines whether or not a detection of a resonance frequency is started. If it determines that the detection is not started, the control returns to step 201. Otherwise, processing in step 205 is executed (step 204).

The driving force detecting section 15B detects a current value of a piston driving force supplied to the piston 12A by the piston driving section 13A (step 205). The control section 18C increases and decreases a frequency of the piston driving force supplied to the piston 12A by the piston driving section 13A (step 206). The driving force detecting section 15B detects a current value after the control section 18C increases and decrease the frequency in the step 206 (step 207). The control section 18C compares the current value detected by the driving force detecting section 15B in the step 205 with the current value detected by the driving force detecting section 15B in the step 207 (step 208). If a current value before changing the frequency is the minimum as a result of the comparison in the step 208, the frequency which is not changed is determined as a resonance frequency and then the control returns to the step 201 (step 209(*a*)). If a current value after increasing the frequency is the minimum, the frequency which has been increased is considered as a frequency of the piston driving force supplied to the piston 12A by the piston driving section 13A and then the control returns to the step 205 (step 209(*b*)). If a current value after decreasing the frequency is the minimum, the frequency which has been decreased is considered as a frequency of the piston driving force supplied to the piston 12A by the piston driving section 13A and then the control returns to the step 205 (step 209(*c*)).

In determining whether or not the control section 18C starts to detect the resonance frequency in the step 204, it is assumed that the determination is made by whether or not a certain period of time has been elapsed by using, for example, a timer. The frequency increased or decreased by the control section 18C in the step 206 can be either a predetermined value or a value which can be entered by a user on each occasion by using an input device.

As described above, the vibrating compressor of the seventh embodiment comprises the piston driving section 13A for giving a piston driving force to the piston 12A, the driving force detecting section 15B for detecting a current value of a piston driving force given to the piston 12A by the piston driving section 13A, the displacement detecting section 14A connected in an axial direction of the piston 12A the frequency detecting section 17B for detecting a frequency based on a piston position signal from the displacement detecting section 14A, and the control section 18C for increasing or decreasing a frequency of a piston driving force supplied to the piston 12A by the piston driving section 13A every certain period of time by a certain amount, and if a current value detected by the driving force detecting section 15B after increasing or decreasing the frequency is smaller than that before increasing or decreasing the frequency, considering the frequency of the smaller current value as a frequency of the piston driving force given to the piston 12A by the piston driving section 13A, and determining a frequency detected by the frequency detecting section 17B as a resonance frequency of the piston 12A and the resonance spring 14B by repeating the increase or decrease of the frequency until the current value detected by the driving force detecting section 15B before increasing or decreasing the frequency becomes smaller than that after both cases of increasing and decreasing the frequency to consider it as a frequency of the piston driving force given to the piston 12A by the piston driving section 13A, therefore, the vibrating compressor can run without decreasing an efficiency of compression even if there is a difference between the driving frequency and the resonance frequency of the piston 12A and the resonance spring 14B at an occurrence of any change of an external condition such as a temperature condition or a pressure condition since the control section 18C detects the resonance frequency and changes the frequency of the piston driving force supplied to the piston 12A by the piston driving section 13A to the resonance frequency.

As described above, according to the first embodiment of the present invention, by setting the displacement detecting section connected in an axial direction of the piston, the upper dead point position detecting section for detecting an upper dead point position of the piston based on a piston position signal from the displacement detecting section, and the driving force control section for changing a driving force supplied to the piston by the piston driving section according to a difference between the upper dead point position and the preset upper dead point position reference value immediately after the upper dead point position detecting section detects the upper dead point position, the vibrating compressor can run without unstable strokes of the piston so as to prevent a decrease of a compression efficiency as well as without a damage of a valve caused by a strike of the piston against the valve even at a change of an intake pressure or an ejecting pressure in the cylinder of the vibrating compressor or a refrigerant temperature.

Furthermore, the vibrating compressor of the second embodiment according to the present invention comprises a displacement detector connected in an axial direction of the piston, the converter circuit for converting an alternating power to a direct power, the inverter circuit for converting a direct current to an alternating current by switching transistors and applying a voltage to the coil, the upper dead point position calculation means for calculating an upper dead point position of the piston based on a piston position signal from the displacement detector, and the amplitude control means for changing an output voltage of the inverter circuit according to a difference between the upper dead point position and a preset upper dead point reference value, therefore, the vibrating compressor does not cause any over strokes of the piston by changing an output voltage of the inverter circuit according to a difference between the upper dead point position and the upper dead point reference value to keep the upper dead point of the piston at the reference value at all times even if an external condition changes. Accordingly, the intake valve and the ejector valve in the cylinder are not damaged by the piston striking the top of the cylinder.

The vibrating compressor of the third embodiment according to the present invention comprises the stroke calculation means for calculating a stroke of the piston based on a piston position signal from the displacement detector and the amplitude control means for changing an output voltage of the inverter circuit according to a difference between the stroke and a preset stroke reference value, therefore, it does not cause any change of its refrigerating capability by changing an output voltage of the inverter circuit according to a difference between the stroke and the stroke reference value to keep the stroke of the piston at the reference value at all times even if an external condition changes.

Furthermore, the vibrating compressor of the fourth embodiment according to the present invention comprises the upper dead point position calculation means for calculating an upper dead point position of the piston based on a piston position signal from the displacement detector, the stroke calculation means for calculating a stroke of the piston based on the piston position signal, and the inverter control means for changing an output voltage amplitude of the inverter circuit according to a difference between the stroke and a preset stroke reference value and changing an output voltage direct current component of the inverter circuit according to a difference between the upper dead point position and a preset dead point reference value, therefore, it does not cause any change of its refrigerating capability by changing the output voltage amplitude of the inverter circuit according to the difference between the stroke and the stroke reference value to keep the stroke of the piston at the reference value at all times even if an external condition changes. In addition, the vibrating compressor does not cause any over strokes of the piston by changing a direct voltage component of the inverter circuit according to the difference between the upper dead point position and the upper dead point reference value to keep an upper dead point of the piston at the reference value at all times. Accordingly, the intake valve and the ejector valve in the cylinder are not damaged by the piston striking the top of the cylinder.

Still further, the vibrating compressor of the fifth embodiment according to the present invention comprises the upper dead point position calculation means for calculating an upper dead point position of the piston based on a piston position signal from the displacement detector, the stroke calculation means for calculating a stroke of the piston based on the piston position signal, the frequency comparator circuit for detecting a difference between an output frequency of the inverter circuit and a frequency of the piston position signal, and the inverter control means for changing an output voltage amplitude of the inverter circuit according to a difference between the. stroke and a preset stroke reference value and dissolving a difference between an output frequency of the inverter circuit and a frequency of the piston position signal by changing an output voltage direct current component of the inverter circuit according to a difference between the upper dead point position and a preset upper dead point reference value and by changing the output frequency of the inverter circuit, therefore, it does not cause any change of its refrigerating capability by changing the output voltage amplitude of the inverter circuit according to the difference between the stroke and the stroke reference value to keep the stroke of the piston at the reference value at all times even if an external condition changes. In addition, it does not cause any over strokes of the piston by changing the direct voltage component of the inverter circuit according to the difference between the upper dead point position and the upper dead point reference value to keep an upper dead point of the piston at the reference value at all times. Therefore, the intake valve and the ejector valve in the cylinder are not damaged by the piston striking the top of the cylinder.

In addition, the vibrating compressor of the fifth embodiment can maintain the highest efficiency at all times, running with a higher efficiency by utilizing resonance characteristics of the spring system since the output frequency of the inverter circuit, that is, the frequency f1 is equal to the frequency of the piston position signal, that is, the resonance frequency f2 of the mechanical system formed by the refrigerant gas and the resonance spring.

Furthermore, according to the sixth embodiment of the present invention, the vibrating compressor comprises the piston driving section for supplying a piston driving force to the piston, the driving force detecting section for detecting a current value of the piston driving force supplied to the piston by the piston driving section, the displacement detecting section connected in an axial direction of the piston, the frequency detecting section for detecting a frequency based on a piston position signal from the displacement detecting section, and the control section for changing stepwise a frequency of the piston driving force supplied to the piston by the piston driving section every certain period of time within a certain range by certain amounts and determining a frequency detected by the frequency detecting section when a current value detected by the driving force detecting section becomes the minimum as a resonance frequency of the piston and the resonance spring to consider it as a frequency of the piston driving force supplied to the piston by the piston driving section, therefore, the vibrating compressor can run without decreasing its compression efficiency since the control section detects the resonance frequency and changes the frequency of the piston driving force supplied to the piston by the piston driving section to the resonance frequency even if there is a difference between the driving frequency and the resonance frequency of the piston and the resonance spring at occurrence of any change of an external condition such as a temperature condition or a pressure condition.

According to the seventh embodiment of the present invention, the vibrating compressor comprises the piston driving section for supplying a piston driving force to the piston, the driving force detecting section for detecting a current value of the piston driving force supplied to the piston by the piston driving section, the displacement detecting section connected in an axial direction of the piston, the frequency detecting section for detecting a frequency based on a piston position signal from the displacement detecting section, and the control section for increasing or decreasing a frequency of a piston driving force supplied to the piston by the piston driving section every certain period of time by a certain amount, and if a current value detected .by the driving force detecting section after increasing or decreasing the frequency is smaller than that before increasing or decreasing the frequency, considering the frequency of the smaller current value as a frequency of the piston driving force supplied to the piston by the piston driving section, and determining a frequency detected by the frequency detecting section as a resonance frequency of the piston and the resonance spring by repeating the increase or decrease of the frequency until the current value detected by the driving force detecting section before increasing or decreasing the frequency becomes smaller than that after both cases of increasing and decreasing the frequency to consider it as a frequency of the piston driving force supplied to the piston by the piston driving section, therefore, the vibrating compressor can run without decreasing a compression efficiency even if there is a difference between the driving frequency and the resonance frequency of the piston and the resonance spring at an occurrence of any change of an external condition such as a temperature condition or a pressure condition since the control section detects the resonance frequency and changes the frequency of the piston driving force supplied to the piston by the piston driving section to the resonance frequency.

What is claimed is:

1. A vibrating compressor, comprising:

a tubular cylinder having an intake valve and an ejector valve;

a piston movable axially in said cylinder;

permanent magnet arranged in said cylinder;

a coil workable to said permanent magnet with being opposite to said permanent magnet, the coil installed in said piston;

a resonance spring connected to said piston;

a position detector for detecting an axial position of said piston and generating a piston position signal;

a piston driving means for driving said piston by applying a current to said coil so that said coil generates a driving force;

an upper dead point position calculation means for calculating an upper dead point position of said piston by using said piston position signal from said position detector; and a driving force control means for changing a driving force of said piston driving means according to a difference between said upper dead point position and a preset upper dead point reference value.

2. A vibrating compressor according to claim 1, wherein said piston driving means includes a converter for converting alternating power to direct power and an inverter circuit for converting the direct current from said converter to an alternating current by setting on or off a switching element and applying the voltage to said coil and said driving force control means includes an inverter control means for changing an output voltage of said inverter circuit according to a difference between said upper dead point position and said preset upper dead point reference value.

3. A vibrating compressor, comprising:

a tubular cylinder having an intake valve and an ejector valve;

a piston movable axially in said cylinder;

permanent magnet arranged in said cylinder;

a coil workable to said permanent magnet with being opposite to said permanent magnet, the coil installed in said piston;

a resonance spring connected to said piston;

a position detector for detecting an axial position of said piston and generating a piston position signal;

a piston driving means for driving said piston by applying a current to said coil so that said coil generates a driving force, the piston driving means including a converter for converting alternating power to direct power and an inverter circuit for converting the direct current from said converter to an alternating current by setting on or off a switching element and applying a voltage to said coil;

an upper dead point position calculation means for calculating an upper dead point position of said piston by using said piston position signal from said position detector;

a stroke calculation means for calculating a stroke of said piston from said piston position signal; and an inverter control means for changing an output voltage of said inverter circuit according to a difference between the calculated stroke and a preset stroke reference value and changing an output voltage direct current component of said inverter circuit according to a difference between the calculated upper dead point position and a preset upper dead point reference value.

* * * * *

UNITED STATES PATENT AND TRADEMARK OFFICE

CERTIFICATE OF CORRECTION

PATENT NO. : 5,897,296
DATED : April 27, 1999
INVENTOR(S) : Yamamoto et al.

It is certified that error appears in the above-identified patent and that said Letters Patent is hereby corrected as shown below:

Assignee Field:
Please insert -- Matsushita Refrigeration Company --.

Signed and Sealed this

Ninth Day of October, 2001

*Attest:*

Nicholas P. Godici

NICHOLAS P. GODICI
*Acting Director of the United States Patent and Trademark Office*

*Attesting Officer*